US010145188B2

(12) United States Patent
Smith et al.

(10) Patent No.: US 10,145,188 B2
(45) Date of Patent: Dec. 4, 2018

(54) AUTOMATED ROD MANIPULATOR

(71) Applicant: Layne Christensen Company, Kansas City, KS (US)

(72) Inventors: Brian Smith, The Woodlands, TX (US); Stefano Campanini, Piacenza (IT); Gianmaria Vitali, Collecchio (IT); James Maggert, Fort Myers, FL (US); Paul Mander, Spring, TX (US)

(73) Assignee: Layne Christensen Company, Kansas City, KS (US)

( * ) Notice: Subject to any disclaimer, the term of this patent is extended or adjusted under 35 U.S.C. 154(b) by 415 days.

(21) Appl. No.: 14/164,053

(22) Filed: Jan. 24, 2014

(65) Prior Publication Data

US 2014/0209382 A1 Jul. 31, 2014

Related U.S. Application Data

(60) Provisional application No. 61/785,365, filed on Mar. 14, 2013, provisional application No. 61/757,009, filed on Jan. 25, 2013.

(51) Int. Cl.

| | |
|---|---|
| ***E21B 19/14*** | (2006.01) |
| ***E21B 19/15*** | (2006.01) |
| ***E21B 19/24*** | (2006.01) |
| ***E21B 19/20*** | (2006.01) |

(52) U.S. Cl.

CPC ..... *E21B 19/20* (2013.01); *E21B 19/14* (2013.01); *E21B 19/15* (2013.01); *E21B 19/155* (2013.01); *E21B 19/24* (2013.01)

(58) Field of Classification Search

CPC ..... E21B 19/14; E21B 19/15; E21B 19/155; E21B 19/24; E21B 19/20

See application file for complete search history.

(56) References Cited

U.S. PATENT DOCUMENTS

| | | | |
|---|---|---|---|
| 2,448,324 | A | 8/1948 | Pool |
| 6,283,702 | B1 | 9/2001 | Devlugt et al. |
| 6,311,788 | B1 | 11/2001 | Weixler |
| 6,543,551 | B1 | 4/2003 | Sparks et al. |
| 7,228,919 | B2 | 6/2007 | Fehres et al. |

(Continued)

FOREIGN PATENT DOCUMENTS

| | | |
|---|---|---|
| DE | 19701172 A1 | 7/1998 |
| GB | 1072763 | 6/1967 |
| WO | 9929999 A1 | 6/1999 |

*Primary Examiner* — Cathleen R Hutchins
(74) *Attorney, Agent, or Firm* — Husch Blackwell LLP

(57) ABSTRACT

An automated rod manipulator system for moving a drill rod section from a storage magazine to a drill rig and connecting the drill rod to a drill string of the drill rig without manual manipulation of any parts. The automated rod manipulator system may comprise a magazine to store and dispense a plurality of drill rod sections, a carriage to convey one of the plurality of drill rod sections from the magazine to a transfer position; and a gripping arm coupled to a drill rig mast of a drilling rig, the gripping arm operable to convey one of the plurality of drill rod sections from a transfer position to a position aligned with a spindle center line of the drilling rig. The automated rod manipulator may also include a control system and an alignment assembly for aligning the drill rod section on a spindle centerline of the drill rig.

17 Claims, 23 Drawing Sheets

(56) References Cited

U.S. PATENT DOCUMENTS

| | | | | |
|---|---|---|---|---|
| 7,537,424 | B2 | 5/2009 | Innes et al. | |
| 8,113,762 | B2 | 2/2012 | Belik | |
| 8,215,888 | B2 | 7/2012 | Tetley et al. | |
| 8,419,335 | B1 | 4/2013 | Orgeron | |
| 2004/0007388 | A1 | 1/2004 | Mills et al. | |
| 2004/0131449 | A1 | 7/2004 | Thompson | |
| 2005/0056122 | A1 | 3/2005 | Belik | |
| 2007/0092358 | A1* | 4/2007 | Innes | E21B 7/02 414/22.51 |
| 2009/0014215 | A1 | 1/2009 | Hartke | |
| 2009/0238663 | A1 | 9/2009 | Littlely | |
| 2012/0097454 | A1 | 4/2012 | Kockeis et al. | |
| 2013/0213715 | A1 | 8/2013 | Ferrari | |

* cited by examiner

AUTOMATED ROD MANIPULATOR

CROSS-REFERENCE TO RELATED APPLICATIONS

This application claims the benefit of U.S. Provisional Patent Application No. 61/757,009 filed Jan. 25, 2013, and U.S. Provisional Patent Application No. 61/785,365 filed Mar. 14, 2013. The entire disclosures of U.S. Provisional Patent Application Nos. 61/757,009 and 61/785,365 are hereby incorporated by reference.

BACKGROUND OF THE INVENTION

Field of the Invention

The present invention is in the field of drilling into the earth's crust, such as to discover and extract oil, minerals, water, or other natural resources.

Description of Related Art

The manual handling and manipulation of drilling rod by workers is one of the more dangerous jobs associated with drilling into the earth's crust across all industries. Thus, to increase the safety of drilling rig workers, thereby reducing down-time associated with injuries and potential liability, there is a need in the art for a system that automatically retrieves a drilling rod from a storage position and manipulates the drill rod sections into an in-line position and into engagement with the drill string and rotary drive for drilling into the earth's crust.

In addition, most drilling methods employ a fluid such as air, water or mud to cool and lubricate the bit and to flush and convey cuttings away from the bit face. The drilling fluid is admitted through a swivel that is connected in some manner to the upper terminal end of the drill string. In many drilling methods the swivel inner stem and outer housing attach to the rotary drive or kelly drive. However, for the chuck-drive diamond core drilling method the swivel inner stem is attached to the upper terminal end of the drill string and the outer housing is attached to a wire rope hoist. On a chuck-drive drill rig a hollow rotary drive contains a chuck with internal grippers which clamps to and imparts rotational and axial motion to the drill string. Because the upper end of the drill string can be far out of reach above the chuck, current practice requires the operator to manually screw the swivel stem onto a newly added drill rod before it is hoisted into position to the top of the drill string. In a similar manner the operator must manually unscrew the swivel stem out of a rod which has been removed and lowered from the upper terminal end of the drill string. Consequently, this manual handling of the swivel has made it problematic to automate the complete rod handling cycle in a totally hands-free manner for the chuck-drive drill rigs. Thus, there is a need in the art for a system or device that allows an operator to safely add and remove drill rods to and from the drill string in a completely hands-free manner

SUMMARY OF THE INVENTION

The present invention is related to an Automated Rod Manipulator (ARM) system for use on drilling rigs (earth boring rigs) to provide safe, hands-free manipulation of a drill rod section back and forth between a drilling position that is within the drill rig mast and a storage position wherein the drill rod section is stored in a magazine located near the drill rig. The ARM is not limited to manipulating only a drill rod section but can also be used for handling core sampling barrels and other tubular members which may be used during a drilling process. A person of skill in the art will appreciate that the ARM may be easily configured and adapted to be used for drilling in the mineral, water, geotechnical, environmental, petroleum, and natural gas industries. The present disclosure describes one embodiment directed towards an ARM for use on a diamond core drilling rig. The principal components of the system may include: an arm, a carriage, and a drill rod storage magazine which may be applied across a number of industries.

The ARM may comprise a magazine to store and dispense a plurality of drill rod sections, a carriage to convey one of the plurality of drill rod sections from the magazine to a transfer position, and a gripping arm coupled to a drill rig mast of a drilling rig, the gripping arm operable to convey one of the plurality of drill rod sections from a transfer position to a position aligned with a spindle center line of the drilling rig.

The magazine may be used to store the plurality of drill rod sections and comprises at least one column space defined by a pair of laterally adjacent upper support beams and a pair of laterally adjacent lower support beams below the upper support beams. The magazine may further comprise a plurality of vertically orientated column doors disposed between the upper and lower support beams to laterally support a stack of one or more of the plurality of drill rod sections disposed in the at least one column space, and a plurality of rod-retaining latches operably connected to the lower column support beams and extending into the column space. The rod-retaining latches are pivotally disposed within the column space and supporting the weight of the stack of one or more of the plurality of drill rod sections within the at least one column space.

The carriage may include a lift tray configured to raise to engage a lower-most drill rod section of the stack of one or more of the plurality of drill rod sections within the at least one column space. The lift tray may be operable to lower and remove the lower-most drill rod section and convey the lower-most drill rod section to and from a hard-stop location. While at a hard-stop location, the lift tray positions the drill rod section at a transfer position wherein the drill rod section is presented to the gripping arm. The transfer position may include the lift tray being fully lowered, fully raised, or anywhere in-between. The lift tray may also include a plurality of release levers to engage and pivot the rod-retaining latches to release the lower-most drill rod section of the stack of one or more drill rod sections for removal from the magazine. The ARM may include a jack-up base that supports the carriage and the magazine. The jack-up base may include at least four support legs, the support legs may provide vertical and/or horizontal adjustment of the position of the jack-up base relative to the support surface and/or the drill rig and the gripping arm.

The gripping aim may include a main aim having at least one clamp for securing the one of the plurality of drill rod sections, a pivot drive for pivoting the main arm and the one of the plurality of drill rod sections between a substantially horizontal position and a substantially vertical position, and a swing drive for swinging the main arm and the one of the plurality of drill rod sections into alignment with a spindle centerline of the drill rig.

The ARM may also include a control system for monitoring and controlling the operation of the ARM and the drill rig. The ARM may also include and an alignment assembly for aligning the drill rod section on a spindle centerline of the drill rig. The alignment assembly may be a rod alignment assembly coupled to a foot clamp of the drill rig, or a drill spindle alignment device coupled to the drill spindle or chuck drive. In one embodiment, the drill rig may be a chuck-drive drilling system, and the system may include an automatic rod tripping assembly for threading a swivel onto a drill rod section when the drill rod section is located at a position aligned with the spindle center line of the drilling rig.

The present invention may also include a method for using the ARM to add a drill rod section to a drill string. The method may include the following steps: removing the drill rod section from the bottom of a stack of one or more drill rod sections in a column space of a storage magazine with a lift tray of a carriage; lowering the lift tray of the carriage to a transport position wherein the drill rod section rests upon the lift tray; translating the lift tray and the drill rod section on one or more rails to a hard-stop position; positioning the lift tray and the drill rod section at a transfer position wherein the transfer position may be substantially horizontal; gripping the drill rod section with at least one clamp on a main arm of a gripping arm, wherein the gripping arm may be operably connected to a mast of the drill rig; translating the drill rod section from the transfer position to a pivot position using a motorized roller of the at least one clamp; pivoting the drill rod section and the main arm with a pivot drive of the gripping arm to a substantially vertical position, wherein the drill rod section is substantially parallel with a longitudinal axis of the mast of the drill rig; swinging the drill rod section and the main arm with a swing drive of the gripping arm so that a longitudinal axis of rotation of the drill rod section is substantially aligned with a spindle centerline of the drill rig; and engaging the drill rod section with an existing drill string and a drill string rotary drive.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
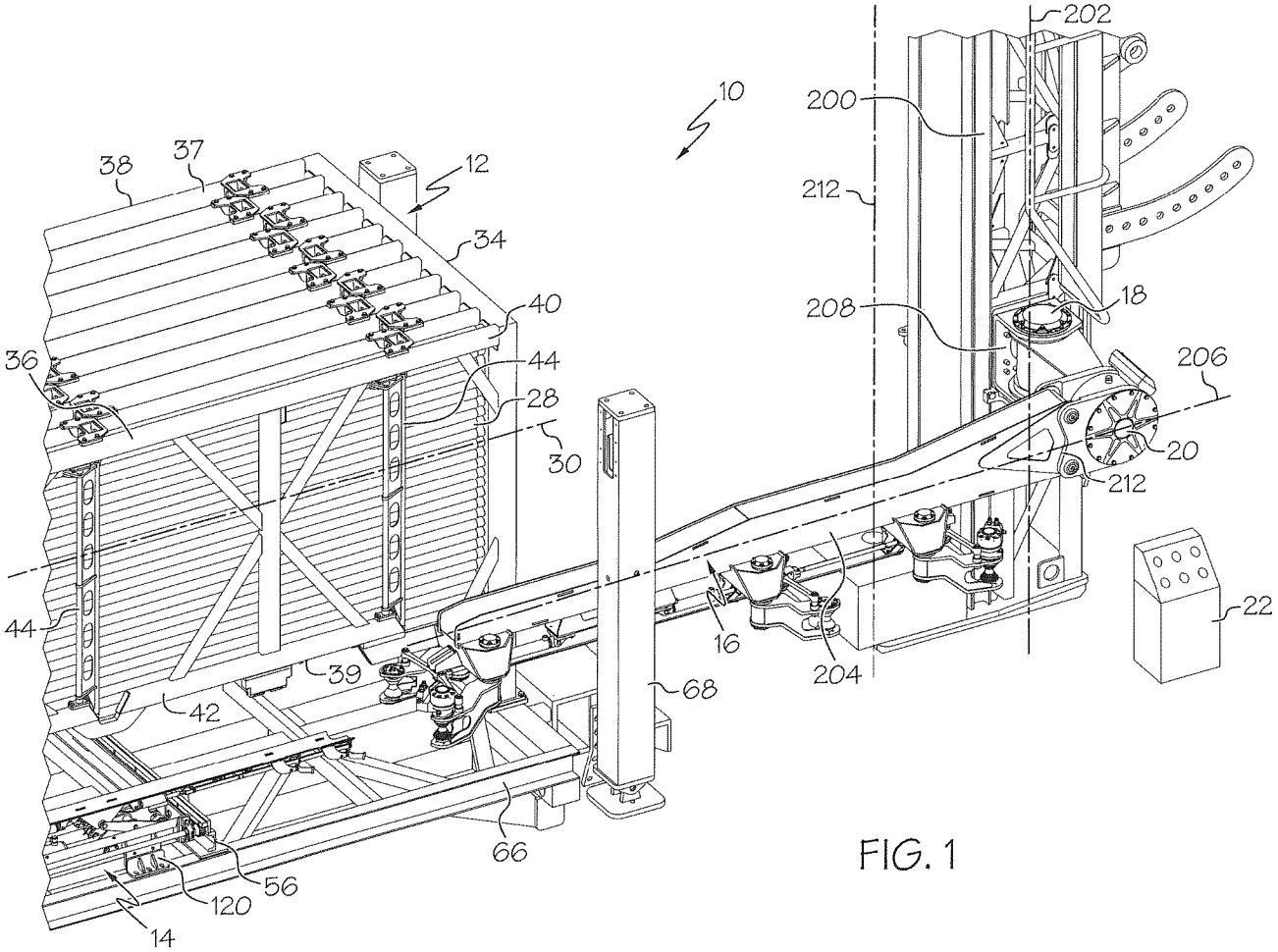
FIG. 1 is a front perspective view of one embodiment of an automated rod manipulator system in accordance with the teachings of the present disclosure.

The present invention is directed toward an automated drill rod manipulator 10 that can be used in any subterranean drilling application. Automated drill rod manipulator 10 may be referred to herein as an automated rod manipulator or an "ARM" and such ten is may be used interchangeably. As shown in FIG. 1, automated rod manipulator 10 generally comprises a drill rod storage magazine 12, a drill rod carriage 14, a motorized gripping arm 16 having both a swing drive 18 and a pivot drive 20, and a control system 22. Automated drill rod manipulator 10 may also include a rod alignment assembly 24 (shown in FIGS. 13A and 13B), a drill spindle alignment device 550 (FIGS. 14A and 14B) and an automated rod tripping assembly 26 (shown in FIG. 15A and FIG. 15B). Once gripping aim 16 has positioned the drill rod section on a spindle centerline, rod alignment assembly 24, drill spindle alignment device 550, and automated rod tripping assembly 26 are used to connect or disconnect a drill rod section to or from the rotary drive and the current drill string in the drill rig. The rod alignment assembly 24 is used to align the added drill rod section using a top-drive drilling rig and automated rod tripping assembly 26 is used primarily with a chuck-drive drilling rig. Spindle alignment device 550 can be used with both drilling systems with the drill spindle and/or a water swivel as further described below.

As shown in FIG. 1, rod storage magazine 12 is a rack designed for columnar storage of drill rod sections 28 for use in the drilling operations. As referenced herein, drill rod section(s) 28 shall refer to the drill rod section 28 shown in FIGS. 1, 7, 15A, and 17-20 in the event drill rod section 28 is not shown in the cited figure. As a person of skill in the art will appreciate, each drill rod section 28 has a longitudinal axis of rotation 30. The magazine 12 may be configured to store drill rod section 28 having an outside diameter between around 56 mm and around 400 mm. Magazine 12 may be configured to store drill rod sections 28 having three (3) meter, six (6) meter, and ten (10) meter industry standard rod lengths or any non-standard lengths desired in a drilling operation. One embodiment of magazine 12 may be configured to store both three (3) and six (6) meter lengths. Moreover, a person of skill in the art will appreciate that magazine 12 can be scaled to accommodate a drill rod section 28 having virtually any usable diameter and length.

Magazine 12 has a first end 32 (FIG. 17) and a second end 34 that define a length and a first side 36 and second side 38 that define a width. Magazine 12 has a top 37 and a bottom 39 that define a height that can be arbitrarily chosen to provide a desired total rod storage capacity. One embodiment (not shown) may include a height to store one thousand five hundred (1500) meters of a drill rod section 28 having an outer diameter of fifty-six millimeters (56 mm) and lesser total lengths of larger diameter drill rod sections 28. However, the height of magazine 12 could provide for any number of drill rod sections stacked horizontally as desired by a drilling team or a particular circumstance. One relevant consideration in the selection of a height and a width for magazine 12 is that magazine 12 may be carried over-the-road by a semi-truck or similar vehicle and would have to be less than the maximum height for over-the-road transport. Such maximum vehicle height varies from state to state in the United States, but is generally between thirteen feet, six inches and fourteen feet, six inches. Such maximum over the road vehicle width is around eight-feet six-inches (8'-6"). Other global jurisdictions may have their own maximum vehicle heights and widths which may influence the selection of height and width.

One alternative embodiment (not shown) is for the dimensions of magazine 12 (height, width and length) to be compatible with the ISO standard shipping container dimensions. Magazine 12 may also include the standard ISO shipping container connections as this allows the magazine to be easily transported to and from a drill site using conventional and readily available shipping equipment. Moreover, the standardization of the size of the magazine to the ISO standard allows for a modular construction of the present automated rod manipulator system. However, a magazine 12 of any size having any desired capacity, heights, or widths are within the scope of the present invention. One embodiment of magazine 12 may be disassembled, transported, and re-assembled on-site as needed.

Figure 2A:
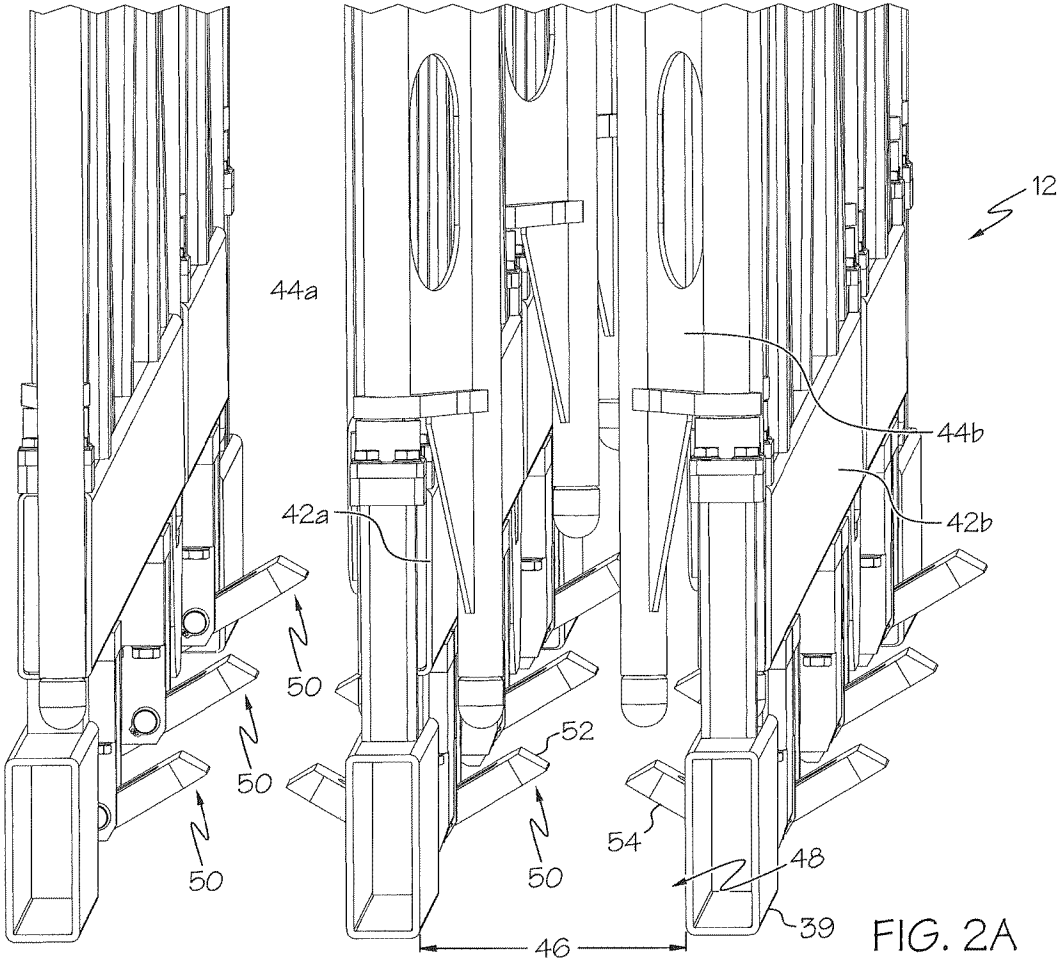
FIG. 2A is a side perspective view of one embodiment of a magazine of the automated rod manipulator system of FIG. 1.

As shown in FIG. 1, magazine 12 comprises a plurality of upper column support beams 40 and lower column support beams 42 positioned directly below upper column support beams 40. A plurality of column doors 44 are disposed and span between upper column support beams 40 and lower column support beams 42 wherein column doors 44 are spaced along the length of beams 40 and 42. Column doors 44 may be each pivotally mounted between a pair of upper and lower column support beams 40 and 42. Another embodiment includes column doors 44 being fixed column structural members having a fixed width wherein a portion of the column door may extend into column space 46 (FIG. 2A) to define a clear space which corresponds to the diameter of the drill rod sections 28 being stored in column space 46 (FIG. 2A). This embodiment eliminates some of the mechanisms required to provide the self-adjusting spring loaded column doors 44, but still provides lateral support of the stacked drill rod sections.

As shown in FIG. 2A, the void space between any two adjacent column support beams 40 and 42 defines a column space 46 that accommodates the storage of a plurality of drill rod sections 28 (shown in FIG. 1). Each end 32 and 34 (see FIG. 17) of magazine 12 may be enclosed by a plate, bulkhead, or other member (not shown) to prevent a drill rod section from sliding out of the ends of the magazine during transport or placement. Each plate, bulkhead, or other member (not shown) may include an impact absorbing material on its inward side so as to absorb the impact of an end of a drill rod section against the plate, bulkhead, or other member to minimize or prevent damage to the threaded end of the drill rod sections 28 as shown in FIG. 1. Such material may be plastic, wood, foam, gel, neoprene, or any other known material.

Turning back to FIG. 2A, column doors 44*a* between lower column support beam 42*a* and a corresponding upper column support beam (not shown) directly above lower column support beam 42*a*. As shown, column doors 44*a* supported by lower column support beam 42*a* will oppose another row of column doors 44*b* supported by another lower column support beam 42*b* and spanning vertically between support lower column support beam 42*b* and a corresponding upper column support beam (not shown) directly above lower column support beam 42*b*. The opposing column doors 44*a* and 44*b* may function to centralize and laterally support the drill rod sections 28 within column space 46. In one embodiment, column doors 44*a* and 44*b* may be mechanically synchronized to swing inward into column space 46 an equal amount to clamp against the drill rod sections.

Figure 2B:
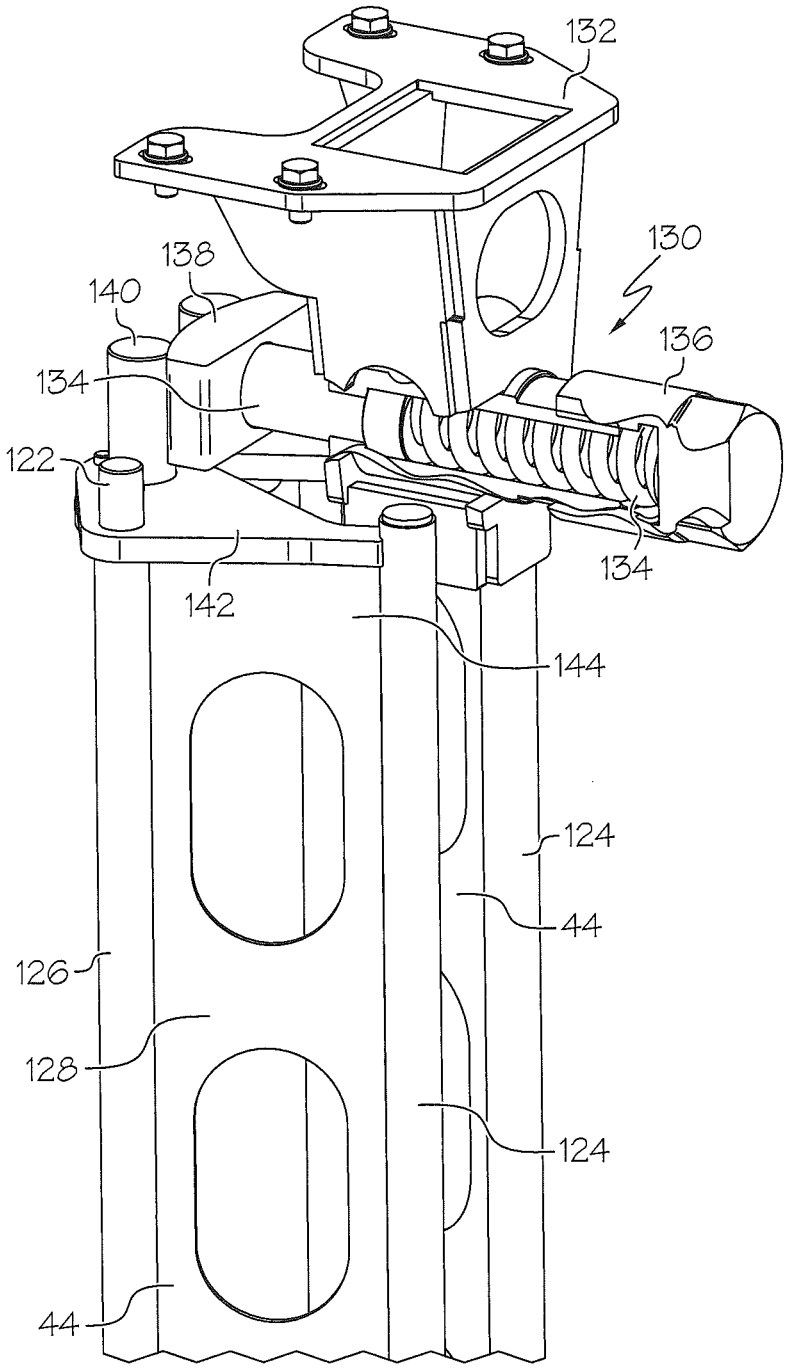
FIG. 2B is a side perspective view of one embodiment of a column door of the magazine of the automated rod manipulator system of FIG. 1.

As shown in FIG. 2B, this embodiment may include the column doors 44 being spring loaded and able to travel within a range of motion necessary to guide any diameter of drill rod section 28 within the size range able to be stored by magazine 12. Column door 44 includes a pivot journal 122 which engages a housing (not shown) on upper column support beam 40 (FIG. 1) and supports the column door for rotation about the pivot journal 122. Column door 44 further includes an outer door post 124, an inner door post 126 and a stiffener plate 126 between the two. Inner door post 126 is aligned with pivot journal 122. The outer door post 124 extends into column space 46 (FIG. 2A) and engages the drill rod sections. As further shown in FIG. 2B, a tensioner 130 is mounted to the upper column support beam 40 (FIG. 1) with a tensioner housing 128. Tensioner 130 includes a tensioner spring 132, a tensioner push rod 134, an adjustment nut 136 to adjust the spring tension, and a cam block 138 coupled to the end of push rod 134. Cam block 138 is configured to engage cam engagement legs 140 disposed on a connection plate 142 at a top 144 of column door 44 wherein engagement legs are offset from pivot journal 122 so as to generate a closing force upon column door 44. The tensioners 130 are biased toward rotating column door 44 inward within column space 46. The bottom of column doors 44 may include similar pivot journals and no tensioner to allow the passage of the drill rod sections 28. Thus, with the tensioner 130 shown in FIG. 2B disposed on column doors 44*a* and 44*b* (FIG. 2A), as shown in FIG. 7, the opposing column doors 44*a* and 44*b* apply equal and opposite forces upon drill rod section 28 to clamp against and laterally support the drill rod section 28 and center it within column space 46.

Figure 7:
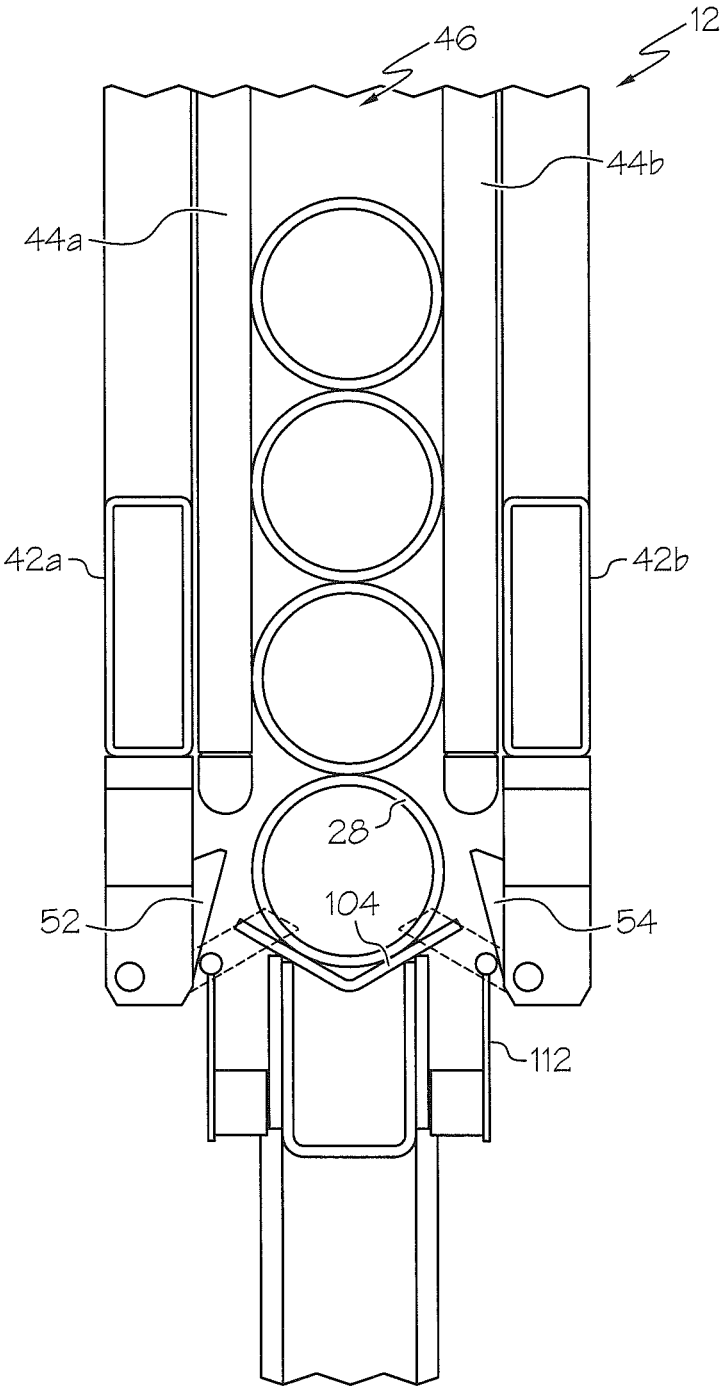
FIG. 7 is a side view of the lift tray of FIG. 4 engaging a stack of drill rod sections in accordance with the teachings of the present disclosure.

Column doors 44*a* and 44*b* generally center the drill rod sections 28 in column space 46 as shown in FIG. 7. In one embodiment, proper guiding of the stack of drill rod sections 28 depends upon only one drill rod section diameter, or very similar diameters, being stored in any given column. However, it is foreseeable that adjacent column spaces 46 may store differing diameters of pipe sections 28 within the diameter range able to be stored in column space 46 (shown in FIG. 2) of magazine 12. Thus, in the case of a fixed width and fixed shape column doors 44, varying widths may be utilized to provide the desired clear space in column space 46 (shown in FIG. 2) as will be appreciated by a person of skill in the art. Magazine 12 may include any number of defined column spaces 46 (shown in FIG. 2) in its width for storing any number of stacks of drill rod sections 28.

Magazine 12 bottom 39 also comprises the lower terminal end 48 of the column space 46. Each lower column support beam 42 bordering each magazine column space 46 includes a plurality of latch pairs 50 disposed along the length of column support beam 42. Each latch pair 50 includes a first latch 52 on a first lower column support beam 42*a* and a second latch 54 opposing first latch 52 on second lower column support beam 42*b*. Latches 52 and 54 may be substantially opposing and aligned from column space to column space, or the opposing latches 52 and 54 may be slightly offset along the length of the lower column support beam 42*a* and 42*b* respectively to facilitate connection of the latches 52 and 54 to the lower column support beams 42 as some lower column support beams 42 have latches on both sides as shown. Latches 52 and 54 may be connected to the top, bottom or sides of the lower column support beams 42.

FIG. 2A illustrates an embodiment wherein each latch 52 and 54 is pivotally mounted to the bottom of lower column support beam 42. Each latch pair 50 blocks and holds the total weight of the vertical stack of drill rod sections 28 stored above the latch pairs 50 and within the column space 46. In one embodiment, there is at least a latch pair 50 proximate each end of the lower column support beams 42. Latches 52 and 54 are both spring loaded and gravity inclined toward a blocked position (shown in FIG. 2A) that does not allow passage of drill rod section out of lower terminal end 48 of the column space 46 in its natural biased position. In one embodiment shown in FIG. 2A, latches 52 and 54 are restrained from pivoting downward in the blocked position and can only be displaced upward to allow a drill rod section 28 to pass by. Another embodiment of magazine 12 shown in FIG. 2A includes three latch pairs 50 along the length of lower column support beams 42*a* and 42*b*, with a latch pair 50 proximate each end and one latch pair 50 proximate a middle of the lower column support beams 42. However, any number of latch pairs 50 may be utilized to provide the necessary strength to support the weight of the stack of drill rod sections 28 held by the latch pairs 50 in each column space 46.

Carriage

Figure 3:
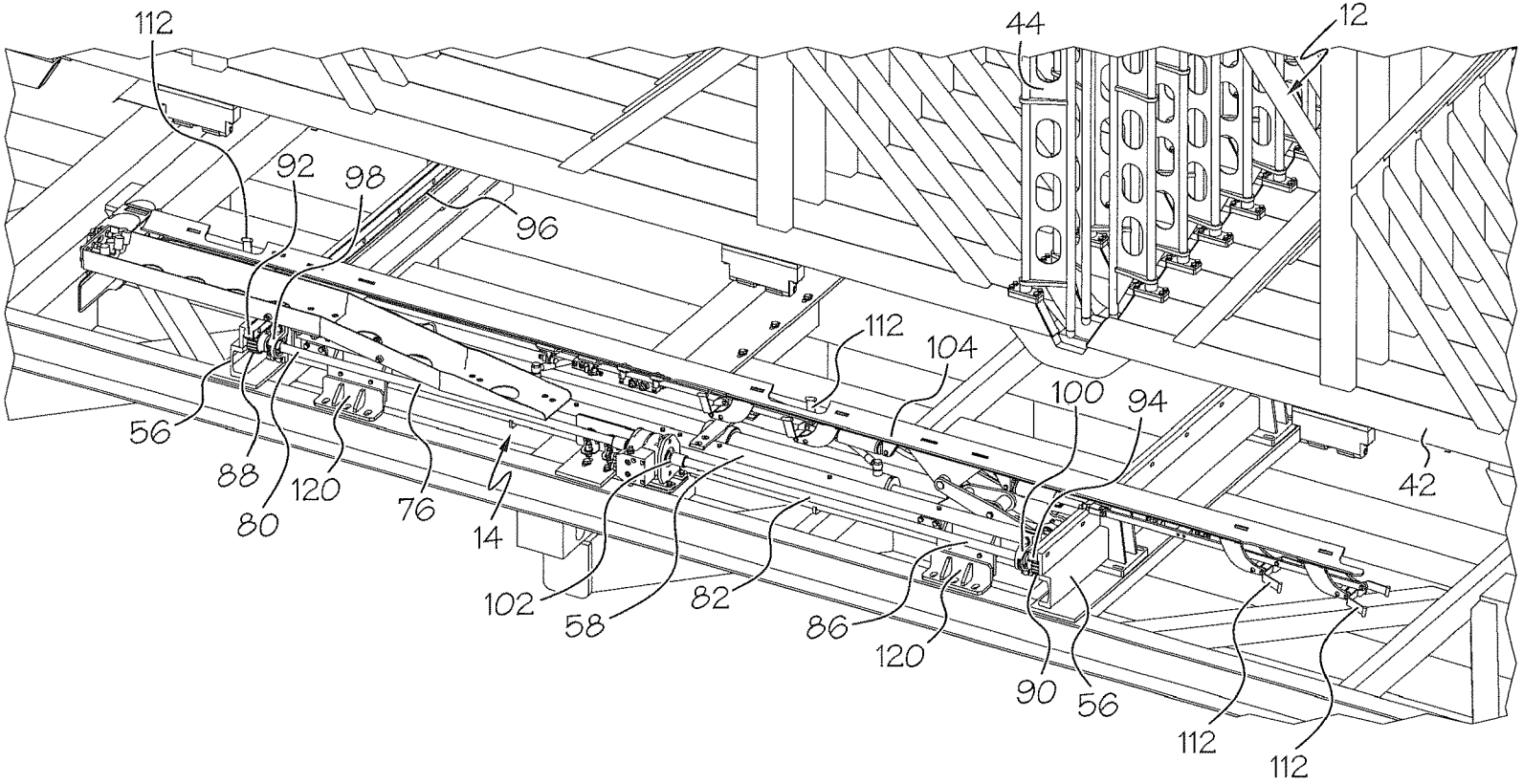
FIG. 3 is a front perspective view of one embodiment of a carriage and rails of the automated rod manipulator system of FIG. 1.
Figure 5:
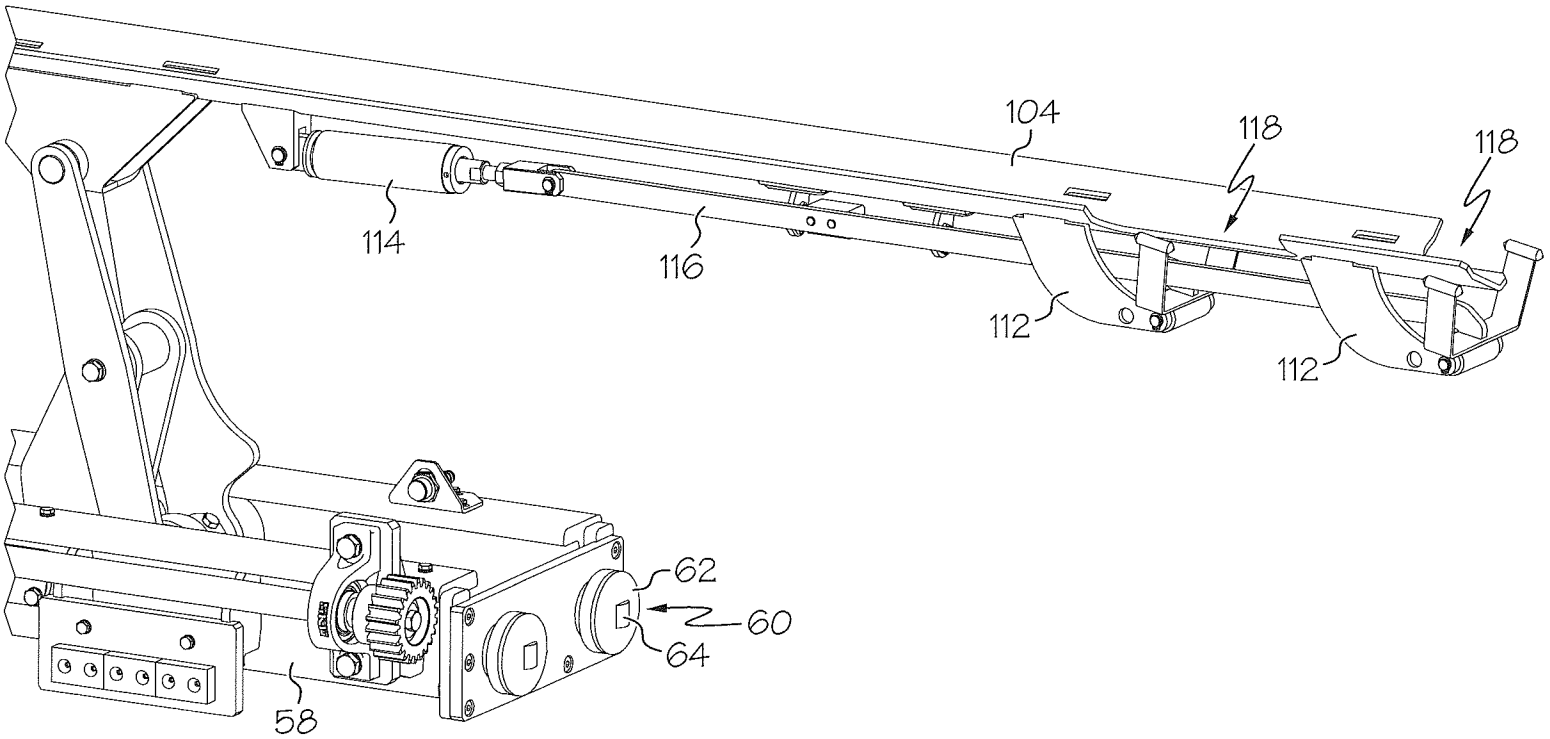
FIG. 5 is an enlarged perspective view of one end of the lift tray of FIG. 4 showing a raised position of release levers.

As shown in FIGS. 1 and 3, drill rod carriage 14 may be motorized and allows an operator to manipulate the drill rod section 28 back and forth between one of the column spaces 46 of magazine 12 and gripping arm 16. As best shown in FIG. 3, carriage 14 is positioned beneath the magazine 12 and is moveable in a direction substantially perpendicular to the central axis 30 of the drill rod sections 28 (not shown in FIG. 3). Carriage 14 is mounted on one or more rails 56 or other similar guide system. As shown in FIGS. 3 and 5, the base frame 58 of carriage 14 is equipped with combination bearings 60 at each end which are designed to roll along rail 56 having a "C" channel shape. In one embodiment, the combination bearings 60 consist of both a main roller 62 that engages the profile rail flanges to accommodate radial loads and a side roller 64 that engages the profile rail web to accommodate axial or side loads. As shown in FIG. 1, rails 56 are mounted upon a jack-up base 66 (which will be described in more detail below) and are disposed perpendicular to the longitudinal axis 30 of the drill rod sections 28 stored in magazine 12 thereby allowing carriage 14 to traverse back and forth between the individual column spaces 46 of magazine 12. Jack-up base 66 includes a plurality of support legs 68 which may act to support magazine 12 and carriage 14 off the ground, wherein support legs 68 may be adjustable to allow vertical and/or horizontal positioning of magazine 12 and carriage 14, particularly, to position magazine 12 and carriage 14 with respect to gripping arm 16 and the drill rig. Additionally, in one embodiment, rails 56 are disposed to allow carriage 14 to traverse beyond the width of the magazine 12, particularly past first side 36 and second side 38 of magazine 12. This configuration allows carriage 14 to cooperate with both gripping arm 16 proximate first side 36 of magazine 12 and a core retrieval station (not shown) that may be positioned proximate second side 38 of magazine 12 to recover core samples taken by a core barrel (not shown). Moreover, carriage 14 being able to travel past the width of magazine 12 on both first and second sides 36 and 38 allows for manually placing a pipe section 28 on carriage 14 to be loaded into or removed from magazine 12.

Figure 4:
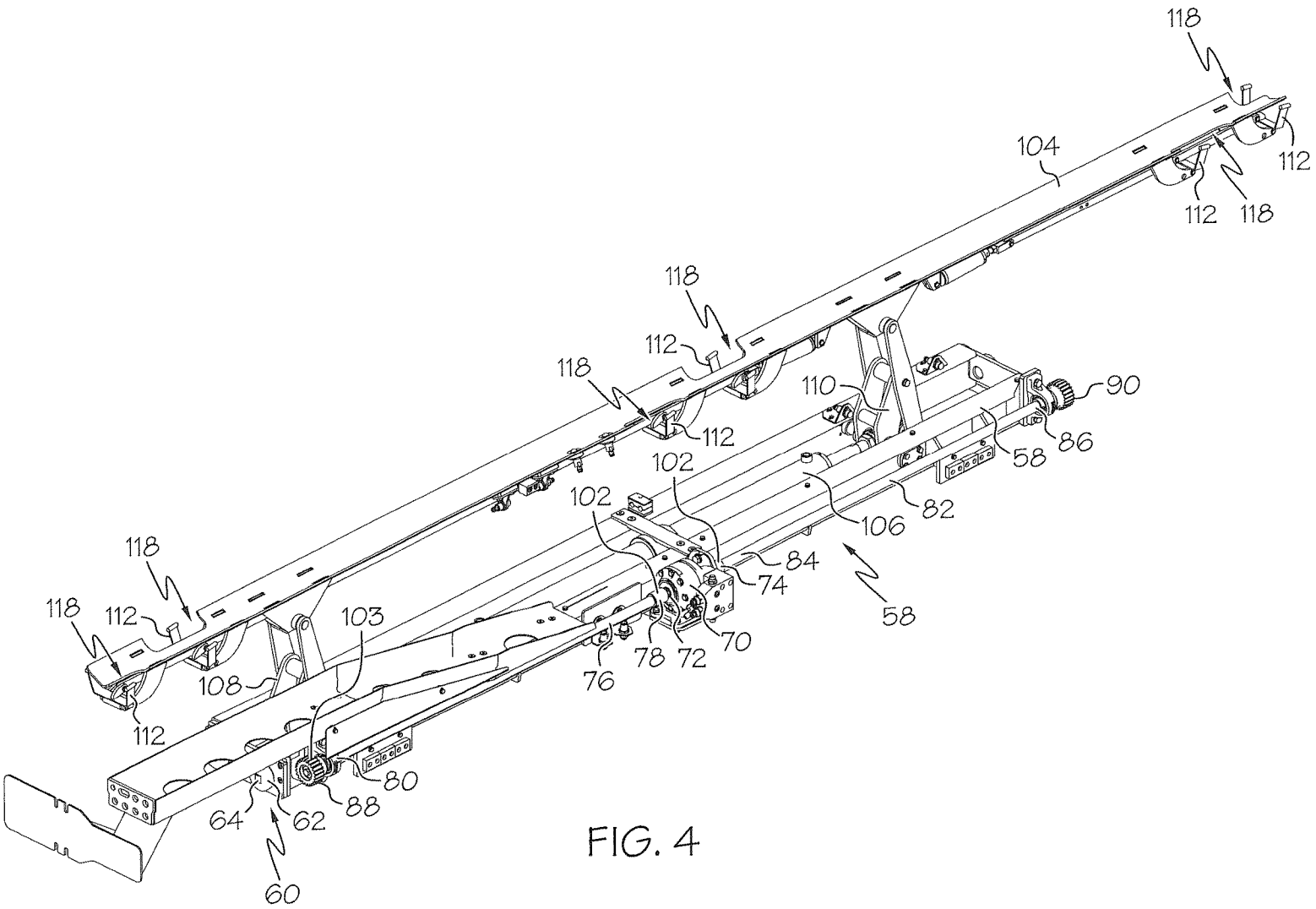
FIG. 4 is a front perspective view of one embodiment of the lift tray of the carriage of FIG. 3.

In one embodiment shown in FIG. 4, the travel of carriage 14 is provided by a hydraulic motor 70 turning a first output shaft 72 and a second output shaft 74 that are aligned and extend from both ends of motor 70 as shown. Hydraulic motor 70 may include a decreasing drive ratio because some hydraulic motors do not have consistent performance at lower drive speeds and the decreasing drive ratio allows the motor to run at a high speed and have the carriage propelled at a lesser speed. As further shown in FIG. 4, first output shaft 72 is operably connected to an inboard end 78 of a first drive shaft 76 and an outboard end 80 of first drive shaft 76 is operably connected to a first pinion 88. Second output shaft 74 is operably connected to an inboard end 84 of a first drive shaft 82 and an outboard end 86 of second drive shaft 82 is operably connected to a second pinion 90.

As shown in FIG. 3, pinions 88 and 90 each rotate along the length of a mating rack (first pinion 88 engages first mating rack 92 and second pinion 90 engages second mating rack 94) mounted near and parallel to each of the profile rails 56 thereby effecting linear motion to carriage 14 upon rotation of drive shafts 76 and 82 by motor 70. As further shown in FIG. 3, in one embodiment racks 92 and 94 may be mounted with its toothed portion 96 facing downward such that dirt accumulation is lessened or prevented. A first outboard bearing 98 provides support to the outboard end 80 of first drive shaft 76 and a second outboard bearing 100 provides support to the outboard end 86 of second drive shaft 82. Outboard bearing 98 and 100 accommodate the forces of motion of carriage 14 as applied to drive shafts 76 and 82. The inboard ends 78 and 84 of the drive shafts 76 and 82 may be connected to output shafts 72 and 74, respectively, by a splined connection 102 so as to transmit torque from motor 70 to pinions 88 and 90. The spline teeth (not shown) of spline connection 102 and pinion teeth 103 (see FIG. 4) may be timed with respect to each other so as to provide precise, synchronized drive motion to either end of carriage 14 to ensure uniform travel thereof.

However, a person of skill in the art will appreciate that any one of a number of motor and transmission configurations may be employed to provide the propulsion and movement of the carriage 14. For example, an electronic, pneumatic or fuel powered motor may also be used. In addition, there are many transmission and gearing configurations that also may be incorporated such as a gear box with a single input and dual output shafts, and a helical, bevel, or worm gearing system. Another embodiment includes one or more synchronized linear actuators to provide the linear translation. Such linear actuators may include hydraulic or pneumatic cylinders, or a rotary ball cylinder device. The ability for the drive system to propel both ends of the carriage 12 and lift tray 104 at a substantially identical speed and distance is desirable as any skew or offset in the orientation of the carriage 12 with respect to the columns of drill rod sections may result in the dropping of a drill rod section or other malfunction of the system.

As shown in FIGS. 3, 4, and 5 carriage 14 is provided with a motorized lift tray 104 that can vertically raise and lower a drill rod section 28 with respect to the carriage base frame 58. Lift tray 104 may lie parallel to and adjacent to drive shafts 76 and 82. As shown in FIG. 4, in one embodiment, the lifting motion is provided by a double-ended hydraulic lift cylinder 106 coupled in synchronization to a first straight-line motion mechanism 108 and a second straight-line motion mechanism 110. However, any number of known lifting mechanisms, such as hydraulic, pneumatic, mechanical, and/or motorized, may alternatively be used to effectuate the raising and lowering of lift tray 104 relative to carriage base frame 58.

Figure 6:
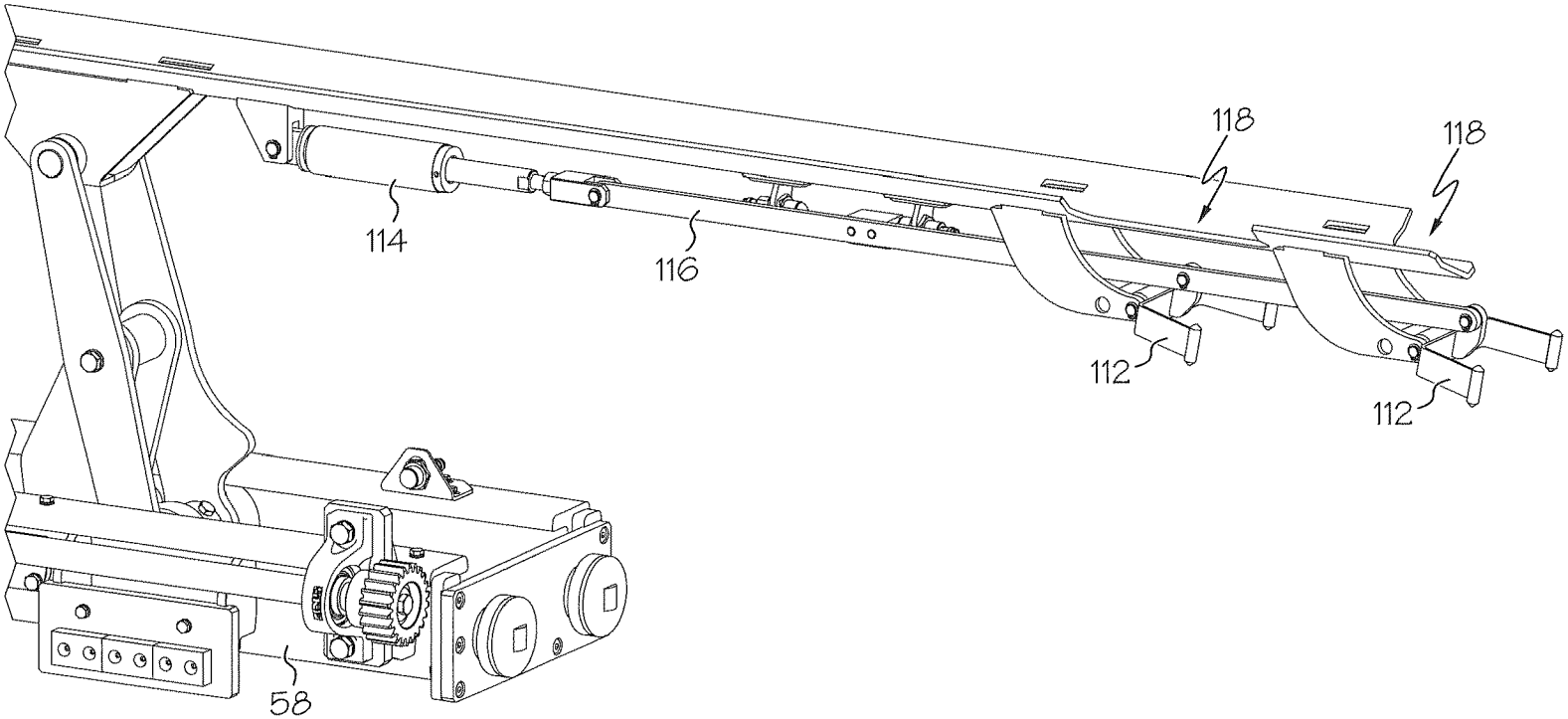
FIG. 6 is an enlarged perspective view of one end of the lift tray of FIG. 4 showing a lowered position of release levers.

As further shown in FIG. 4, lift tray 104 is provided with a plurality of release levers 112 that are pivotally coupled to lift tray 104 and when raised engage and lift rod support latches 52 of magazine 12 (shown in FIG. 2A) to an open position for the purpose of allowing one and only one drill rod section 28 to be removed by lift tray 104. As shown in FIGS. 5 and 6, release levers 112 are activated by a combination of one or more hydraulic cylinders 114 and one or more connecting rods 116 which are connected to the pivotally mounted release levers 112. When hydraulic cylinder 114 is retracted, levers 112 raise to a raised position. As shown in FIG. 6, when hydraulic cylinder 116 is extended, levers 112 lower to a lowered position. When release levers 112 are rotated to this lowered, essentially horizontal position they will not contact rod support latches 52 of magazine 12. A person of skill in the art will appreciate that there are a number of hydraulic, pneumatic, electronic, or other mechanisms that can similarly raise and lower levers 112.

As shown in FIG. 3, a pair of elastomer cushioned hard stops 120 is provided to stop the translation of carriage 14 on first side 36 of magazine 12 to a position aligned with gripping arm 16. In this position lift tray 104 can position a drill rod section 28 at a transfer position so that it can be gripped by gripping arm 16 or, alternatively, at the transfer position, a drill rod section 28 can be released from gripping arm 16 onto lift tray 104. Similarly, a pair of elastomer cushioned hard stops (not shown) may be provided to stop the motion of the carriage on the second side 38 of magazine 12 to a position in line with a core removal station (not shown). The core removal station contains specialized equipment to remove the retrieved core from the core sampling barrel so that it may be presented to the geologist. Carriage 14 can manipulate core barrels back and forth from the core removal station to the gripping arm 16. In this manner a core barrel (not shown) may be safely handled through its entire range of motion by the ARM system without the need for an operator to manually handle them until it is time to take the core sample in a controlled environment.

As shown in FIG. 7, to release drill rod section 28 from the magazine 12, empty lift tray 104 must be positioned directly beneath the column space 46 of interest. Lift tray 104 is then raised to a raised position where it will engage and lift the lower-most drill rod section 28 in the column space 46 (plus all drill rod sections 28 above the lowest) away from its resting position against latches 52 and 54 (the original position of latches 52 and 54 shown in broken lines). The release levers 112 are then rotated to the upper "release" position (shown in FIG. 5), where levers engage and rotate the latches 52 and 54 upwardly to an open position that allows the passage of the lower-most drill rod section 28. As lift tray 104 is lowered vertically from its raised position, the lower-most drill rod section 28 supported by lift tray 104 is lowered past latches 52 and 54. As lift tray 104 is lowered, release levers 112 are also translated downward and fall out of engagement with latches 52 and 54. Accordingly, the latches 52 and 54 pivot downward and return to their blocking "normal" or biased position thereby engaging the then-lower-most drill rod section 28 and supporting the weight of any and all drill rod sections 28 that are stacked above the drill rod section 28 being withdrawn by the lift tray 104. The geometry and configuration of release levers 112 and latches 52 and 54 is configured to allow the withdrawal of one, and only one, section of drill rod 28 by lift tray 104 during each release operation.

To admit or re-load drill rod section 28 into magazine 12, lift tray 104 and a drill rod section 28 supported on lift tray 104 must be positioned directly beneath the column space 46 of interest. Lift tray 104 and supported drill rod section 28 is then raised to its raised position where supported rod 28 will contact then lift the lower-most drill rod section 28 in the column space 46 (plus any rod sections above the lowest) away from its resting position against latches 52 and 54. As shown in FIGS. 4, 5, and 6, lift tray 104 may include cutouts or recesses 118 to prevent lift tray 104 from contacting and opening latches 52 and 54 and, therefore, latches 52 and 54 will return to their blocked position by spring action after drill rod section 28 supported by lift tray 104 passes up vertically past them. If the release levers 112 remain in their lower, essentially horizontal position, as shown in FIG. 6, then latches 52 and 54 will remain blocked as lift tray 104 is lowered and the entire column of drill rod sections 28 in column space 46 of magazine 12 will remain supported by latches 52 and 54, including the re-inserted drill rod section. Once lift tray 104 is returned to its lowest position, the carriage 14 can traverse back and forth beneath magazine 12 to any position within its range of motion.

Gripping Arm

Figure 8:
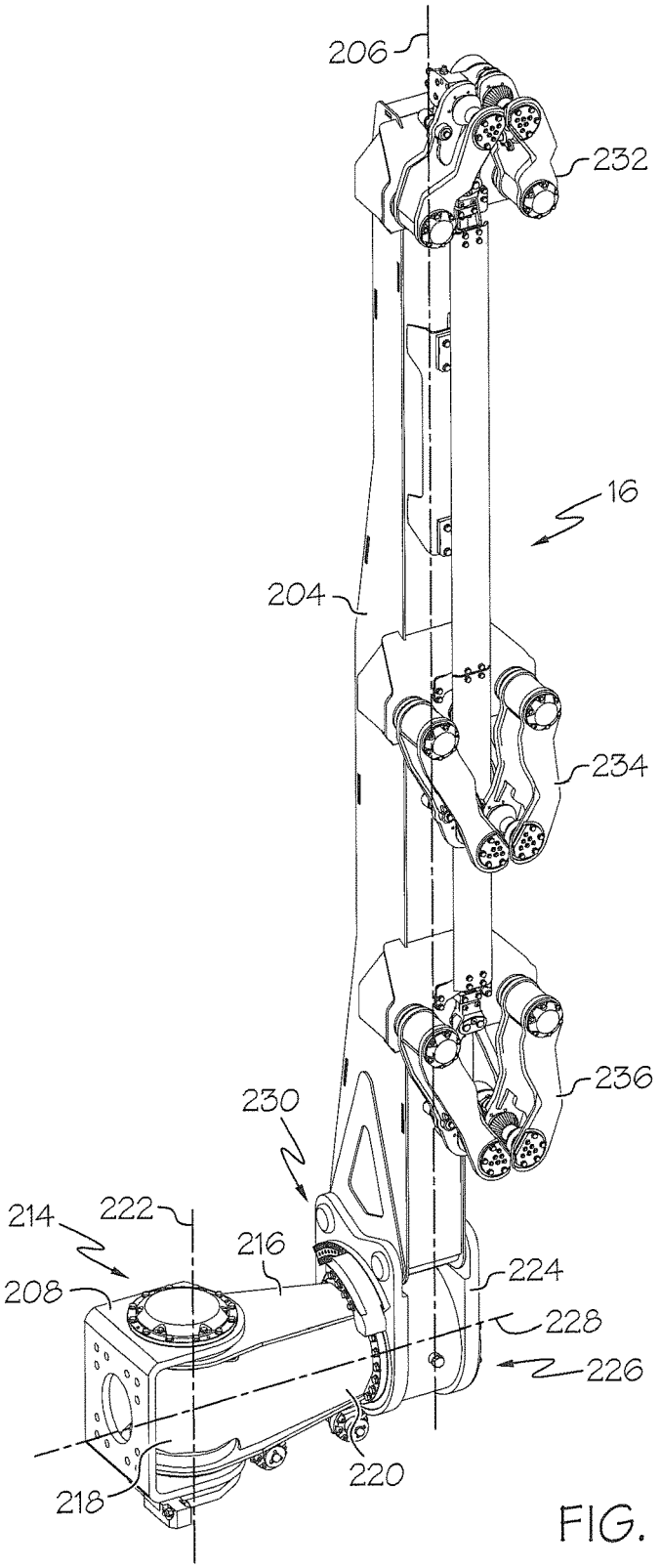
FIG. 8 is a perspective view of one embodiment of a gripper arm of the automated rod manipulator system of FIG. 1 in accordance with the teachings of the present disclosure.

As shown in FIG. 1, gripping arm 16 is pivotally mounted to the side of a drilling rig mast 200. Drilling rig mast 200 has a longitudinal axis 202. Gripping arm 16 may include a main arm 204 having a longitudinal axis 206. Gripping arm 16 manipulates the drill rod section 28 or core barrels back and forth between the lift tray 104 of carriage 14 and the drilling rig spindle centerline 212 that corresponds to the axis of rotation of the drill string. Spindle centerline 212 may also be referred to herein as drill string centerline 212. FIG. 8 illustrates one embodiment of gripping arm 16 that includes a "C" shaped mount 208. As shown in FIG. 1, the "C" shaped mount 208 may be bolted rigidly to the side of the drilling rig mast 200. Alternatively, any number of known connection types may be used such as welding or other rigid bolted connection.

Figure 20:
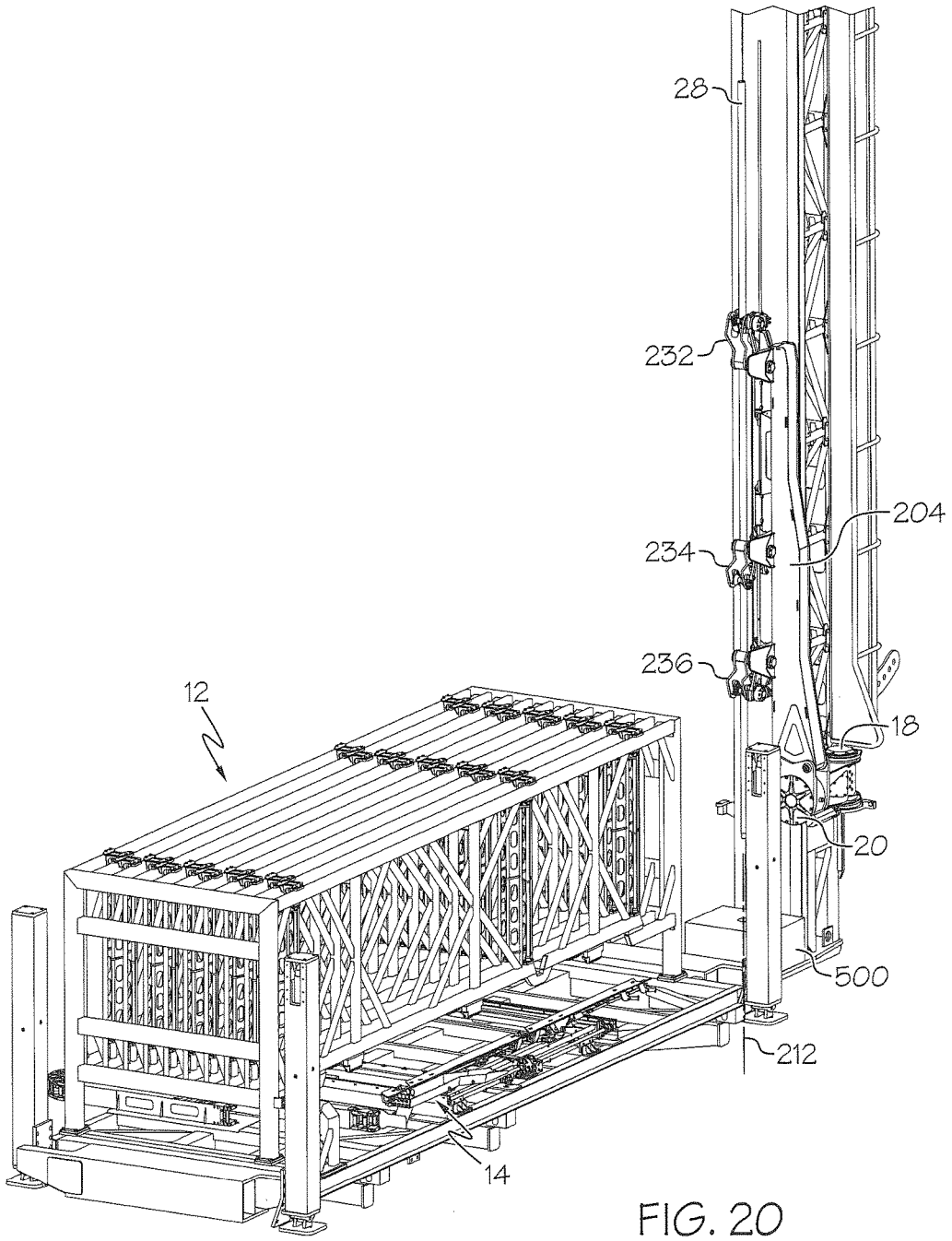
FIG. 20 is a perspective view of the automated rod manipulator system of FIG. 1 showing the drill rod section secured in the gripping arm, pivoted and swung into a substantially vertical position in alignment with a spindle centerline.

Now turning back to FIG. 8, mount 208 straddles and is pivotally mounted to an inboard end 218 of a cross arm 216 of gripping arm 16 at a swing connection 214. Cross arm 216 also has an outboard end 220. Swing connection 214 has a first pivot centerline 222 oriented parallel to the longitudinal axis 202 of drill rig mast 200 so as to create a swinging motion of cross arm 216 and all subsequently attached components into and away from spindle centerline 212 (as shown in FIGS. 1 and 20). Further, a pivot housing 224 is pivotally attached to outboard end 220 of cross arm 216 at a second pivotal connection 226. Second pivotal connection 226 has a second pivot centerline 228 generally oriented perpendicular to longitudinal axis 202 of drill rig mast 200 so as to create a pivoting motion of pivot housing 224 and all subsequently attached components (such as main arm 204) with respect to the drill rig mast 200. Pivot housing 224 is operably coupled to main arm 204 using any known structural connection type, such as through a pinned connection 230 including two pins as shown in FIG. 8.

The range of the pivot motion of second pivot connection 226 is such that longitudinal axis 206 of main arm 204 is able to pivot from an essentially horizontal position in line with lift tray 204 of carriage 14 to an essentially vertical position parallel with the longitudinal axis 202 of drill rig mast 200. It should be noted that to accommodate slant angle drilling it is common that drill rig mast 200 to be oriented at an angle of up to 45 degrees off vertical during the drilling process. The range of pivot motion of second pivot connection 226 may be able to provide the additional angular travel required to cooperate with drill rig mast 200 at an inclined angle. Moreover, swing connection 214 may also include additional range of motion so that it can swing away from drill rig mast 200 to accommodate gripping a drill rod sections stored in a magazine with gripping arm 16 wherein the magazine is positioned along a radial axis outward from a center (not shown) of pivot connection 226 other than the orientation shown in FIG. 1 which requires around a ninety degree swing range of motion. The pivot motion of the swing connections 214 is effectuated by swing drive 18 and pivot connection 226 is effectuated by pivot drive 20. Swing drive 18 and pivot drive 20 may be any hydraulic, pneumatic, electric, or fuel powered motors and transmission system now known or hereafter developed. Particular embodiments of swing drive 18 and pivot drive 20 are described in more detail below.

As shown in FIGS. 1 and 8, in its simplest form, main arm 204 may be one rigid section. However, an embodiment (not shown) may include a telescoping main arm able to telescope in its longitudinal direction which may extend to reach the drill rod section in lift tray 104 or position the end of the drill rod section 28 above the preceding drill rod section in the drill string.

Figure 9:
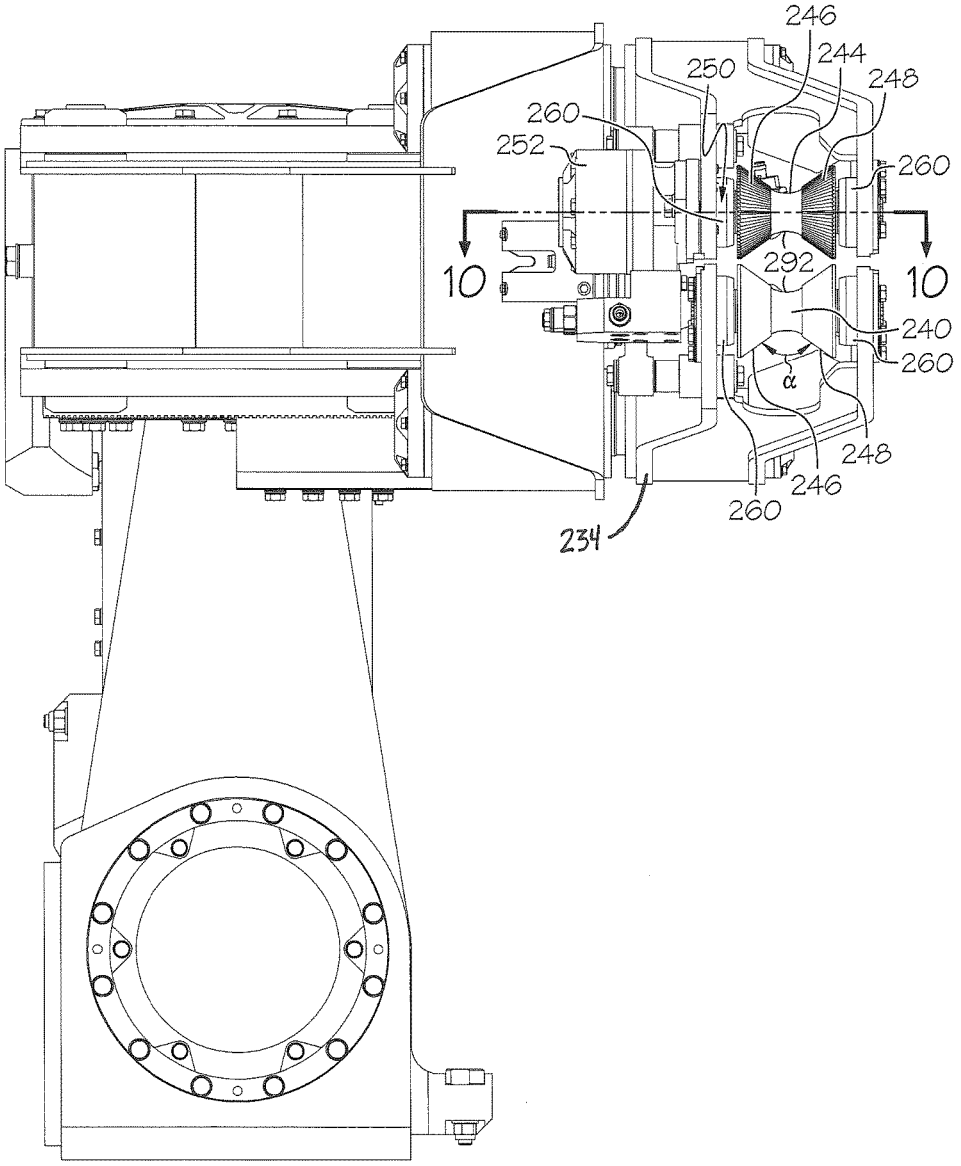
FIG. 9 is a top view of the gripper arm of FIG. 8 in a closed position.
Figure 10:
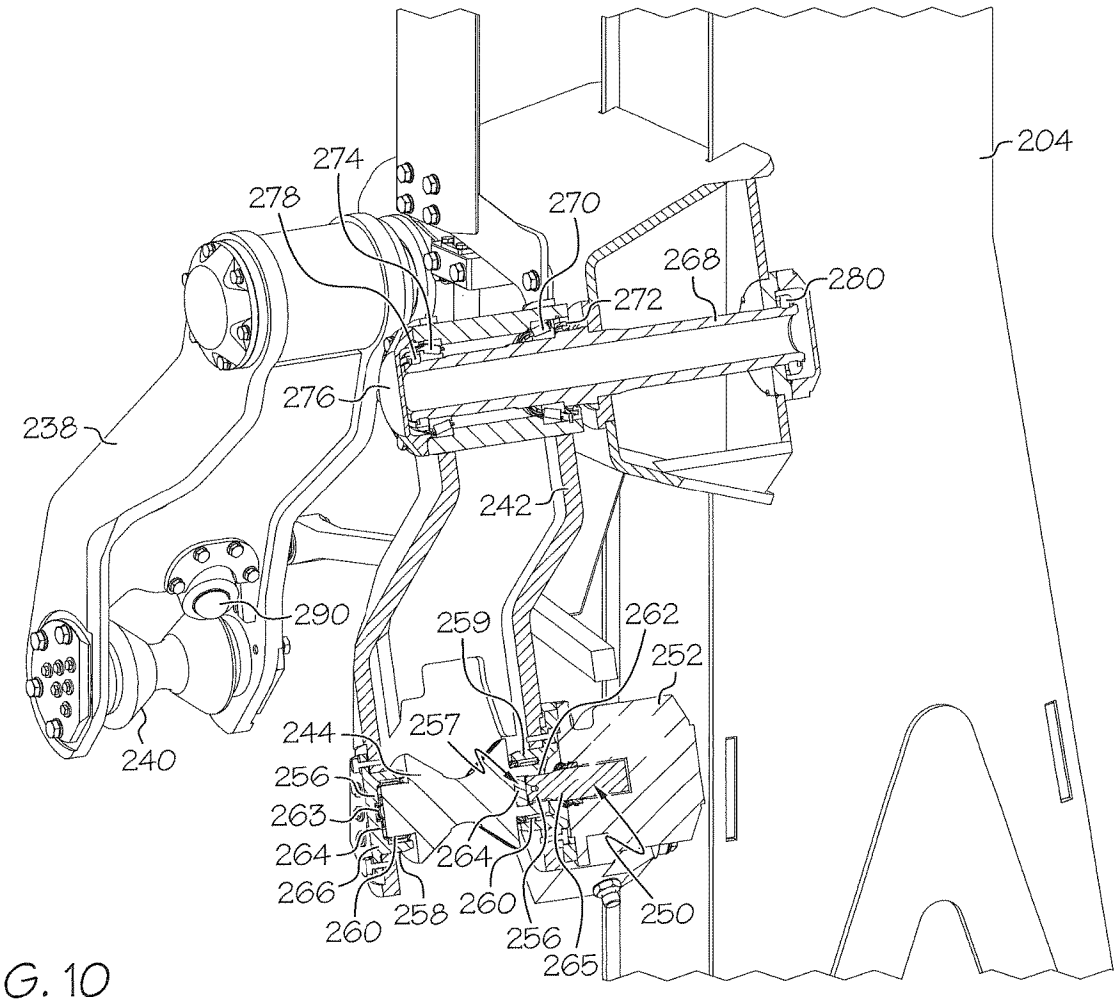
FIG. 10 is a sectional view of a roller clamp of the gripper arm of FIG. 9 cut along the line 10-10 in an open position.

As further shown in FIG. 8, main arm 204 has three pairs of roller clamps positioned along its length to effectively clamp onto and allow translation of a drill rod section (not shown). Main arm 204 includes a first roller clamp 232, a second roller clamp 234, and a third roller clamp 236. The roller clamps 232, 234, and 236 may be hydraulically, pneumatically, or electrically powered. As best shown in FIG. 10, each of roller clamps 232, 234, and 236 comprises a first clamp arm 238 having a first roller 240 journaled for rotation proximate the free end of first clamp arm 238, and a second clamp arm 242 having a second roller 244 journaled for rotation proximate the free end of second clamp arm 242. As best shown in FIG. 9, each roller has a first surface 246 and a second surface 248 that intersect at an internal angle $\alpha$. One embodiment includes the internal angle $\alpha$ being in the range from about eighty (80) degrees to about one hundred-thirty (130) degrees. The internal angle $\alpha$, however, is preferably around one-hundred ten (110) degrees so that the rollers can be used with a variety of diameters of rods.

Figure 21:
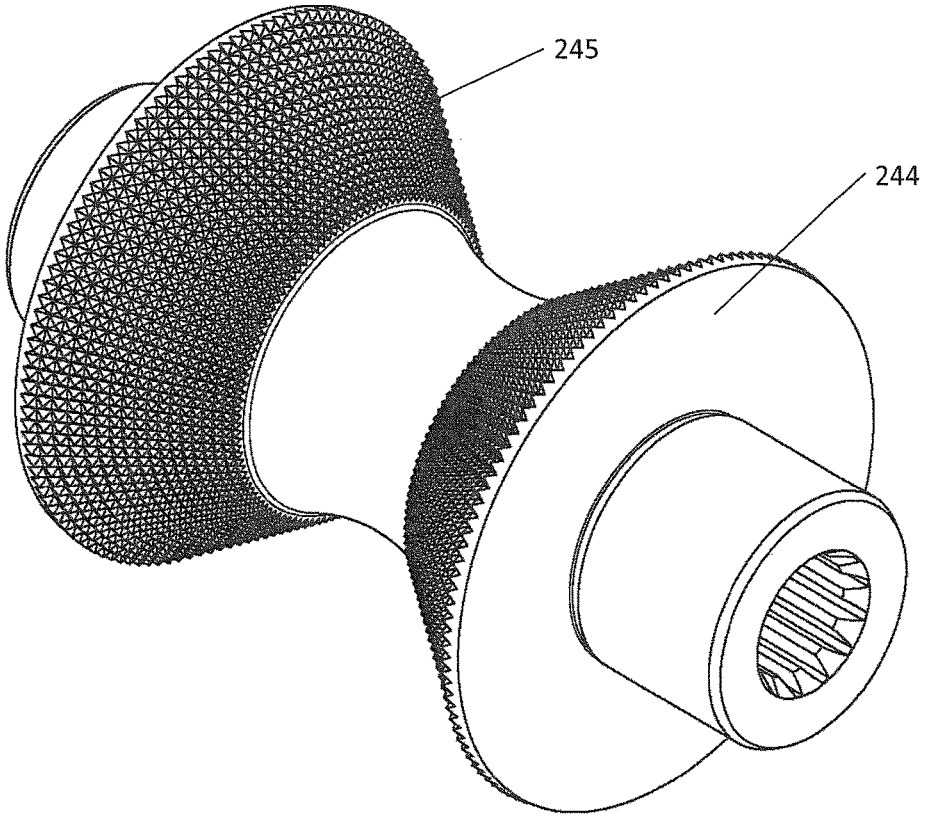
FIG. 21 is a perspective view of one embodiment of a roller of a roller clamp in accordance with the teachings of the present disclosure.

In addition, as shown in FIG. 9, in at least one clamp 232, 234, or 236, first and second surfaces 246 and 248 of second roller 244 is serrated or otherwise textured and first roller 240 has a substantially smooth surface. In another embodiment shown in FIG. 21, second roller 244 may include a cross-serrated surface which may include a plurality of pyramidal shaped fingers 245 on the surface of roller 244. The pyramidal shaped fingers may extend outward and substantially parallel to the roller surface. This design may allow clamps 232, 234, and/or 236 to develop a more secure grip on a drill rod section and additionally resist rotation of the drill rod section when clamped. Rollers 240 and 244 comprise a pair of mutually opposed hour glass shaped rollers. As further shown in FIG. 9, serrated roller 244 may be directly connected via a splined connection 250 to a drive motor 252. FIG. 8 illustrates an embodiment wherein each first clamp 232 and third clamp 236 include its roller 244 driven by a motor 252 and are each operable to cause a linear translation of a drill rod section clamped therein. The motorized roller may also include a brake or lock to prevent the drill rod section from moving once clamped. In addition, in the embodiment shown, second clamp 234 includes both rollers 240 and 244 being free to rotate similarly to rollers 240 of first and third clamps 232 and 236. As such, second clamp 234 as shown grips and supports a drill rod section, but does not include a drive motor to move the drill rod section linearly therein.

Figure 11:
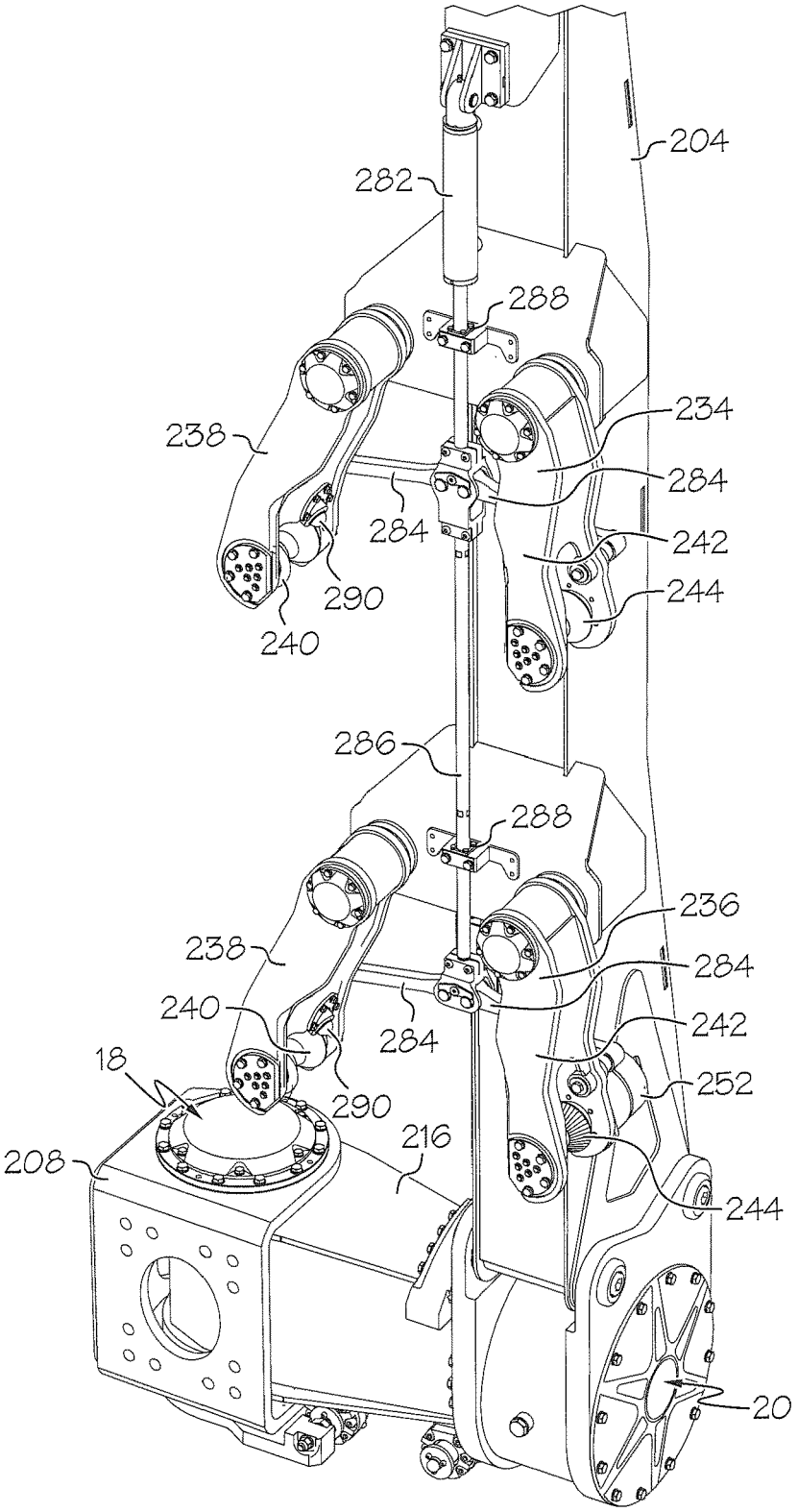
FIG. 11 is a side perspective view of one embodiment of the roller clamps of the gripper arm of FIG. 8 in an open position.

In one embodiment, each of the drive motors 252 are hydraulic and are provided with essentially the same flow rate of hydraulic oil using a commercially available hydraulic flow divider (not shown) with the overall intent to drive both motors in a parallel arrangement at the same rotational velocity. A main arm 204 that includes more than one roller clamp 232, 234, or 236 being driven by a drive motor 252 is preferable because during the normal course of drilling with certain short lengths of drill rod sections it is possible that one end of the drill rod section may come out of contact with the powered drive roller 244 of either the first or third roller clamp 232 and 236 and may be in contact with only the remaining drive roller. If the motorized roller clamps are at each end of the arm (first and third clamps shown in FIG. 8), a drill rod section 28 would remain clamped in the second clamp which stabilizes the clamped position of drill rod section 28 by ensuring that no less than two clamps are engaged with drill rod section 28 at all times. Moreover, as shown in FIGS. 10 and 11, the clamps may include a proximity switch 290 which senses the presence of a drill rod section in the respective clamp and the presence or absence of a drill rod section in a clamp may affect the functionality of the ARM. For example, if all three clamps do not sense the drill rod section, the pivot and swing functions may be disabled.

The serrated surface of roller 244 provides additional friction and gripping force to convey the drill rod section along and through the rollers as drive motor 252 rotates roller 244. Accordingly, any type of roller material or configuration that provides adequate friction to convey the pipe within the arm is within the scope of the present invention. Another embodiment (not shown) may include sharp toothed carbide inserts installed on the surface roller 240 and 244. Another embodiment (not shown) may include providing the rollers 240 and 244 with a thoroughly coated rough carbide surface by a process called HVOF (hyper velocity oxygen fuel) deposition, wherein sharp carbide particles plus a binder are propelled into the surface of the rollers 240 or 244 above the speed of sound (hence "hyper" velocity) so as to be permanently driven or bonded to the surface. These additional surface preparations could be applied to a smooth roller or a serrated roller.

In addition to providing additional friction, the serrations may act as a macro traction feature at their edges and serve to channel debris away from the area of contact at their grooves, while the HVOF coating may provide micro traction with its many sharp asperities biting into the surface of the drill rod section 28. When the drive motors are blocked or prevented from rotating, the serrated rollers do not rotate and the rollers hold the rod in the desired axial position. Rotation of the roller drive motor in the clockwise (CW) and counter-clockwise (CCW) direction causes translation of a gripped drill rod section 28 in the corresponding up and down direction.

As shown in FIG. 10, one embodiment includes each roller 240 and 244 being mounted on clamp arms 238 and 242 and journaled for rotation with respect to clamp anus 238 and 242. In the embodiment shown, roller 244 is mounted to arm 242 by a first journal 258 at one end and a second journal 259 at the other end. Roller 244 rolls against roller radial bearings 260 mounted within the clamp arm 242. Roller 244 may be restrained in the axial direction by a combination of one roller thrust bearing 263 and a thrust plug 264. Roller thrust bearing 263 engages the terminal face 266 of bearing 260 at journal 259. At the other end of roller 244, roller 244 is affixed with an internal spline 262 of spline connection 250 for the purpose of transmitting torque from drive motor 252 to roller 244 using drive shaft 265. A thrust plug 264 may be installed between the terminal end 256 of the motor drive shaft 265 and the end of the internally splined hole 257 in roller 244 for the purpose of resisting axial forces acting towards the direction of motor 252 via the motor's internal shaft bearings (not shown).

Similar to the configuration of end of driven roller 244 at journal 258, non-driven rollers 242 of all clamps and 244 of second clamp 234 may be restrained in the axial direction by a pair of mutually opposed roller thrust bearings 263 that roll against the outer terminal faces 266 of roller journals 258 and 259 respectively. A person of skill in the art will appreciate that rollers 240 and 244 may be alternatively configured and other types of bearings or drive systems now known or hereafter developed that can be used to result in a similar, if not identical functionality.

As further illustrated in FIG. 10, clamp arms 238 and 242 may be pivotally mounted to pivot shafts 268 which are affixed and extend substantially perpendicularly to main arm 204. In the embodiment of FIG. 10, a first (inboard) tapered roller bearing 270 and a second (outboard) tapered roller bearing 274 are mutually opposed and the back-to-back mounting configuration is used to provide both axial and radial positioning of clamp arm 238 or 242 on pivot shaft 268. Sealing of the bearings is provided by a radial lip seal 272 mounted external to the first tapered roller bearing 270 and a sealed cover 276 mounted external to second tapered roller bearing 274. The bearings 270 and 274 are preloaded against each other by means of a retaining nut 278 located external to the second (outboard) tapered roller bearing 274 which draws both bearings tight to the shoulders of mating parts. A second retaining nut 280 is disposed on the opposite end of pivot shaft 268 to secure this end with respect to main arm 204. In this manner a very rigid pivot connection can be provided between the clamp arms 238 and 242 and main arm 204 for safe and accurate positioning of a drill rod section.

Now turning to FIG. 11, one embodiment includes opposing clamp arms 238 and 242 of clamps 234 and 236 rotated inward toward a clamped position against a drill rod section 28 (not shown) under the action of a hydraulic cylinder 282 and connecting rods 284. Other known systems and mechanisms for providing the same or similar closing motion now known or hereafter developed may be utilized. One embodiment illustrated in FIG. 11 includes the second clamp 234 having a single hydraulic cylinder 282 linearly displacing a cylinder rod 286 and thereby effectuating the pivotal movement of each clamp 234 and 236 through a pair of connecting rods 284 pivotally connected to cylinder rod 286. One or more rod guide bearing (bushing) 288 may be provided along the length of the ARM to align the cylinder rod 286 along the centerline of main arm 204 while it strokes back and forth thereby synchronizing the motion of mutually attached clamp arms 238 and 242 of clamps 234 and 236. In this configuration, as clamp cylinder rod 286 is retracted clamp arms 238 and 242 are rotated inwardly to a clamped position. When clamp cylinder rod 286 is extended, clamp arms 238 and 242 are rotated outwardly to an open position. This configuration allows second clamp 234 and third clamp 236 to be opened and closed in unison or in synchronization. In addition, first clamp 232 (FIG. 8) may be activated in a manner similar to the second and third clamps 234 and 236 except clamp arms 238 and 242 of first clamp 232 are moved by a separate cylinder 282, cylinder rod 286 and its own pair of connecting rods 284 having a substantially similar configuration as second and third clamps 234 and 236. In one embodiment (not shown), each roller clamp may be opened and closed by its own hydraulic cylinder to allow each clamp to be independently opened and closed.

When in the "closed" position, there is a clear distance between the hour-glass shaped rollers 240 and 244 which can be set or adjusted to accommodate a drill rod section 28 having a variety of diameters when consistently using the present ARM 10 for the same or similar diameter drill rod. Another embodiment (not shown) may include a pressure switch (not shown) incorporated into the roller clamps wherein the pressure switch measures the clamping force applied to a drill rod section and shuts off the clamping mechanism when a certain force is reached. This embodiment would allow for one set of roller clamps to be utilized for nearly any diameter of pipe.

A variation of the embodiment of FIG. 11 includes a hydraulic pressure sensor with hydraulic cylinder 282 to open and close the clamp arms 238 and 242 and rollers 240 and 244 within the limits of a roller's minimum and maximum range until the rollers 240 and 244 fully engage a drill rod section 28 until a preset clamping pressure has been developed within the clamp cylinder 282. The hydraulic oil will flows through the hydraulic cylinder 282 until the pressure is reached, then it becomes trapped in the cylinder by a device termed a pilot operated check valve or "PO" check valve (not shown). Hydraulic oil flows through a one-way PO check valve and gets trapped in the cylinder by the PO check valve when the desired pressure has been reached. The fluid remains trapped until released so that clamps 232 (FIG. 8), 234, and 236 maintain a constant gripping force on a drill rod section 28. When pilot pressure is applied to this device the check valve opens and releases the oil so that clamps 232 (FIG. 8), 234, and 236 may open. Pressure transducers may be used to indicate whether or not the clamping pressure is within a safe threshold and this condition can allow or disallow further movement of the clamping arms 238 and 242 of clamps 232 (FIG. 8), 234, and 236 and swing drive 18 and pivot drive 20.

Turning back to FIG. 9, one embodiment of the present system includes the hour-glass shaped rollers self-centering the rod section so that the longitudinal axis of rotation 30 of a clamped drill rod section 28 (FIG. 1), regardless of its diameter, is positioned to be substantially perpendicular to, and intersects, a line that passes through a center 292 of opposing hour-glass shaped rollers 240 and 244 in each clamp aim, for all rollers and clamp arms gripping the rod section. In other words, the longitudinal axis of rotation 30 of a clamped drill rod section 28 lies in a plane that passes through the center of all roller jaws which are used to clamp, hold, and move the rod section. Center 292 of rollers 240 and 244 is the point at which the hour-glass shaped roller has its minimum diameter. This self-centering feature is beneficial in that no other mechanism is needed to align longitudinal axis of rotation 30 with the spindle centerline 212 if a driller changes rod diameters. In the embodiment shown, clamps 232 and 236 are operable to translate the drill rod section 28 in a linear direction along the axis of rotation 30 of each drill section being clamped to engage the rotary drive, drill string or other drill rig elements. This linear motion may be synchronized with the rotary force applied to threadably engage members of the drill string or other drill elements. Clamp 234 acts as a guide to guide the translation of a clamped drill rod section.

In another embodiment, at least one clamp arm 232, 234, or 236 may include a motorized rotation roller (not shown) operable to rotate drill rod section 28 about its longitudinal axis of rotation 30. The self-centering feature above also positions a clamped drill rod section 28 such that the rotation roller to rotate drill rod section 28 about its longitudinal axis of rotation 30 thereby automatically threading the drill rod section 28 held by clamps 232, 234, and 236 onto an upper-most drill rod section of the drill string.

Swing Drive

Figure 12:
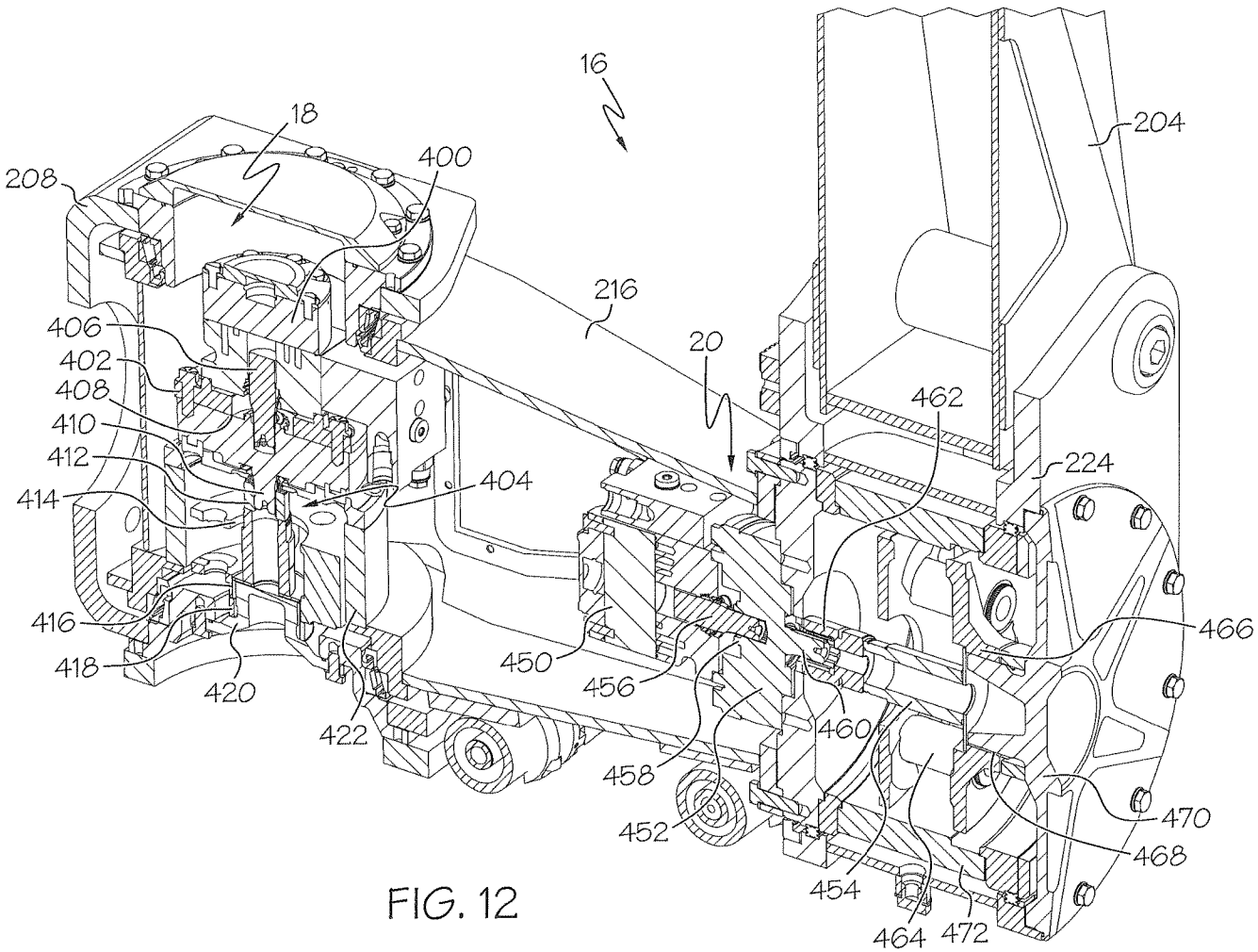
FIG. 12 is a cross-sectional view of a swing drive, a cross arm, and a pivot drive of the gripper arm of FIG. 8 cut along the line 12-12.

As shown in FIG. 12, swing drive 18 provides the swing motion of cross arm 216 and all subsequently mounted components, which motion is created by a hydraulic motor 400 operably connected to a fail-safe brake 402, wherein hydraulic motor 400 drives a two-stage planetary gear drive 404. Swing drive motor 400 includes an output shaft 406 that is operably connected to an input shaft 408 of brake 402. An output shaft 410 of brake 402 is connected to the first stage planetary gear drive input shaft (sun gear) 412. Brake 402 may be released via a hydraulic pilot signal whenever the swing drive motor 400 is activated for motion. When swing drive motor 400 is not functioning and even when total system power is removed fail safe brake 402, acting under spring action, will prevent its output shaft 410 from moving, thereby safely holding the swing drive 18 in its current position. The output of the second stage planetary drive carrier assembly is connected via a splined connection to a torque hub 420. Torque hub 420 is bolted to the arm mount 208 and provides an unmovable reaction point for proper functioning of the planetary drive 404. The planetary drive ring gear 422 is bolted to and provides swing motion to the cross arm 216, connected main arm 204 and all subsequently attached components.

While the embodiment described above uses a hydraulic motor with a planetary gear drive, any other motor type or gear configuration now known or hereafter developed which provides the same or similar swing motion movement of cross arm 216, main arm 204, or both shall be within the scope of the present invention.

Pivot Drive

As shown in FIG. 12, pivot drive 20 provides the pivoting motion of the pivot housing 224, main arm 204 and all subsequently mounted components. Pivot drive 20 includes a hydraulic motor 450, operably connected to a fail-safe brake 452, wherein hydraulic motor drives a planetary gear drive 454. Hydraulic motor 450 includes an output shaft 456 that is operably connected to an input shaft 458 of brake 452. An output shaft 460 of brake 452 is operably connected to a first stage planetary gear drive input shaft (sun gear) 462. The brake 452 may be released via a hydraulic pilot signal whenever the pivot drive motor 450 is activated for motion. When the drive motor 450 is not functioning and even when total system power is removed the fail safe brake 452, acting under spring action, will prevent its output shaft 460 from moving thereby safely holding the pivot drive 20 in its current position. The planetary drive ring gear 472 is bolted to cross arm 216 and provides an unmovable reaction point for proper functioning of the planetary drive 454. An output 466 of the secondary stage planetary drive carrier assembly 464 is connected via a splined connection to a torque hub 470. Torque hub 470 is bolted to and provides pivoting motion to the pivot housing 224, main arm 204, and all subsequently attached components. In addition to the bolted connection a plurality of mating drive splines (not shown) may be provided between the torque hub 470 and pivot housing 224 to augment the torque capacity of pivot drive 20.

While the embodiment described above uses a hydraulic motor with a driving gear drive, any other motor type or gear configuration now known or hereafter developed which provides the same or similar pivot motion movement of main arm 204 shall be within the scope of the present invention.

Control System

The present ARM 10 may be powered and controlled by an electro-hydraulic control system 22 (shown schematically in FIG. 1) consisting of a hydraulic pump, electro-hydraulic directional control valves, electronic controllers, various external sensors, and a radio control unit. Master control of the ARM components begins at the radio control transmitter which is provided with control levers, dials, and switches for all functions. In addition to providing control for the ARM motions the electronic control system has a system of interlocks and safeguards to prevent any dangerous or unwanted movements.

The controls for the ARM may be any manual or automatic control system, or any combination thereof, now known or hereafter developed. A person of skill in the art will appreciate that such control systems by themselves are within the skill of a person of skill in the art of electro-hydraulic controls.

Drill Rod Section Alignment Assembly

Figure 13A:
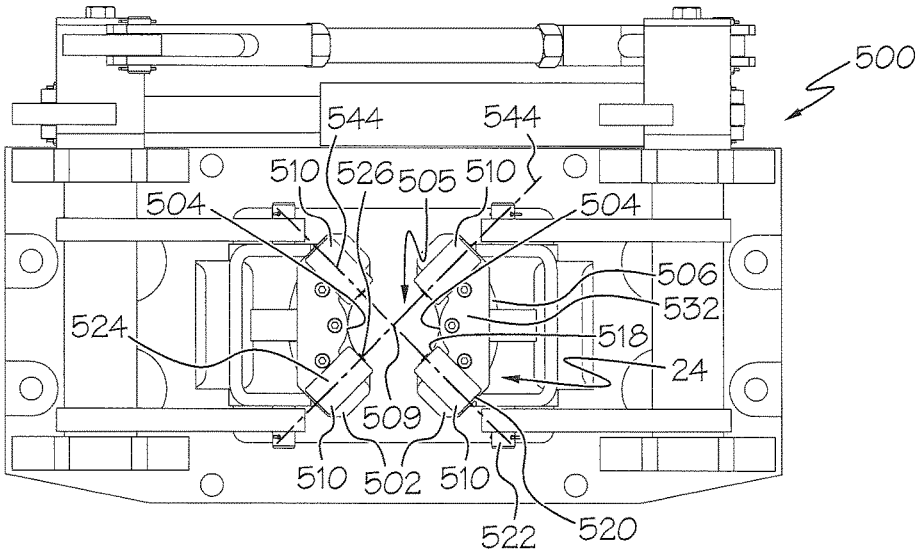
FIG. 13A is a top view of a foot clamp and alignment device that can be incorporated into the automated rod manipulator system of FIG. 1 in accordance with the teachings of the present disclosure.
Figure 13B:
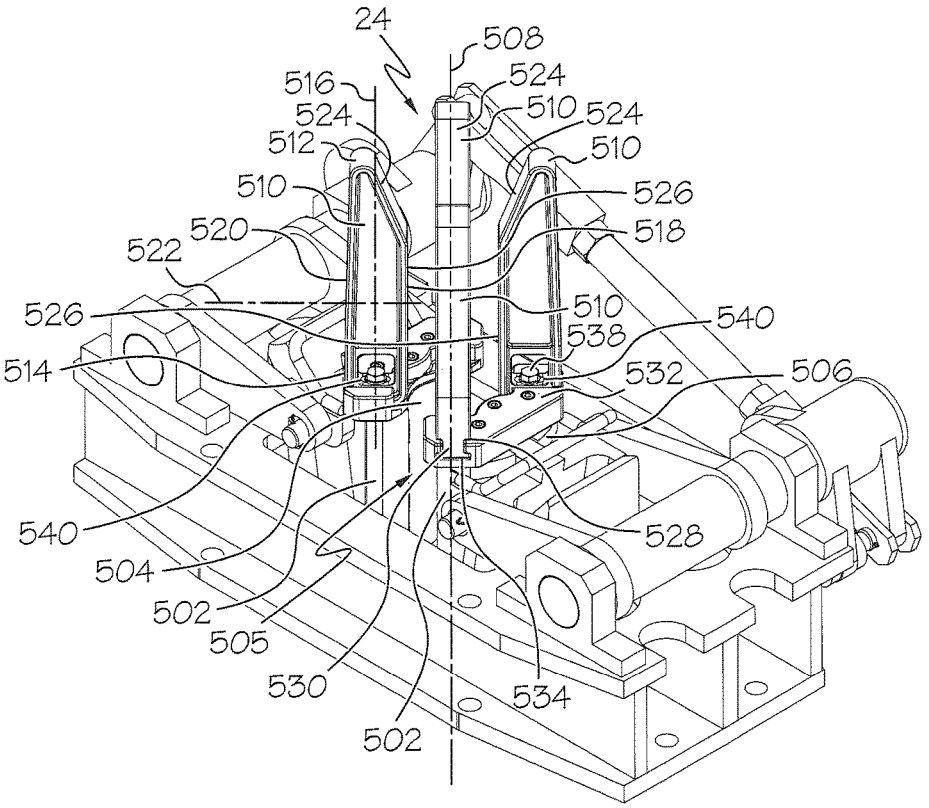
FIG. 13B is a top perspective view of a foot clamp and alignment device that can be incorporated into the automated rod manipulator system of FIG. 1 in accordance with the teachings of the present disclosure.

FIGS. 13A and 13B illustrate a drill rod section string alignment assembly 24 that is used to align the lower end of a drill rod section clamped in gripping arm 16 (FIG. 1) with an upper terminal end of a drill string (not shown) wherein the drill string is being held in position by drill rig foot clamp 500 as known in the art. In one embodiment, foot clamp 500 is generally located on the platform of a drill rig close to where the drill string enters the earth and can be used to grip the drill string when threading on a new drill rod section or for other known reasons. Foot clamp 500 includes a pair of opposing foot clamp jaws 502. Foot clamp jaws 502 include a shaped engagement surface 504 that defines a drill rod opening 505, wherein the shape may be a V-shape or a curved or arc surface having a defined radius. Drill rod opening 505 provides a passageway for the drill string. Drill rod opening 505 may be sized so as to be slightly less than the diameter of the drill rod sections in the drill string so when foot clamp 500 is engaged, it applies a compressive force against the outer surface of the top-most drill rod section in the drill string. The geometry of the shaped engagement surface 504 will determine a centerline 508 through a center 509 of the drill rod opening 505 and clamped drill string. Each clamp jaw 502 may also have a top surface 506. The top of the drill string may be proximate the top surface 506 when adding or removing a new drill rod section. The foot clamp 500 shown in FIGS. 13A and 13B is the type typically used for diamond core drilling. However, alignment assembly 24 may also be used in other foot clamps used for various types of drilling as known in the art.

Alignment assembly 24 may include of a plurality of tapered rod guides 510 which are slidably mounted to the upper surface 506 of each foot clamp jaw 502. The present invention shows four rod guides 510, equally spaced in radial arrangement around the virtual centerline 508 of opening 505 of foot clamp 500.

The rod guides 510 have an upper end 512 and a lower end 514 which define a length and the orientation of a longitudinal axis 516. Each rod guide 510 also includes a front 518 and a back 520 that define a width and the orientation of a width axis 522. Each rod guide 510 includes an angled surface 524 which inclines upwardly from front 518 to back 520. Angle surface 524 allows a bottom end of a drill rod section 28 to slide down the angled surface 524 to be funneled in from a misaligned to an aligned condition while the drill rod section 28 is being lowered to engage the drill string. The slope and length of the angled surface 524 is arranged such that a drill rod section having maximum misalignment does not fall outside the bounds of angled surface 524 at its uppermost portion at back 520. Additionally, each rod guide 510 includes a length of a substantially essentially vertical surface 526 below angled surface 526 at front 518. The introduced drill rod section 28 may be lowered down vertical surface 526 while being threadably engaged with the drill string. It is preferable that vertical surface 526 is a length that is equal to or greater than the length of a threaded portion of drill rod section 28 to prevent unwanted cross threading. It is also preferable for vertical surface 526 to have a length that has additional length when compared to the length of the threaded portion of drill rod section 28 to allow some deviation in the stopping point of the upper terminal end of the drill string (not shown) with respect to its target axial destination within clamp jaws 502. Both angled surface 524 and vertical 526 of rod guide 510 are oriented to face virtual centerline 508 and center 509 of opening 505 of foot clamp 500 so that these surfaces will contact a drill rod section 28 at a point that is tangent or normal to the circular outer surface (not shown) of a drill rod section 28.

Each rod guide 510 includes a slidable connection to a jaw 502. Each rod guide 510 includes T-shaped leg 530 extending from a bottom surface 528. A base plate 532 may be integral with or fixedly mounted to the upper surface 506 of clamp jaw 502 via bolts, screws and/or locating dowels of sufficient size, location and quantity or other known fasteners. Base plate 532 includes a plurality of T-shaped slots 534 that mate with a T-shaped leg 530 extending from bottom surface 528 of one of the rod guides 510. Base plate 532 may also include one or more threaded holes (not shown) in each slot 534 to receive a clamp bolt 538. Additionally, clamp bolt 538 passes through a slotted hole 540 in rod guide 510 and into one threaded hole in slot 534 of base plate 532. The position of rod guide 510 may be adjusted along the length of slot 534 and clamp bolt 528 may be tightened to lock rod guide 510 into position with respect to base plate 532.

T-shaped slot 534 is cut along a line in a direction that is coincident with a line 544 that radiates outward from virtual centerline 508 and center 509 of opening 505. Rod guide 510 can then be linearly adjusted toward and away from virtual centerline 508 and center 509 of opening 505 to accommodate for slight differences in pipe size, component wear, contamination, etc. A minimum of three rod guides 510, ideally equally spaced with respect to each other, would be necessary to fully define virtual centerline 508 and center 509 of opening 505. However, both the number and spacing of rod guides 510 may be changed to any reasonable amount. As shown in FIGS. 13A and 13B, the ARM 10 includes four rod guides 510 and that allow for a symmetrical arrangement of guides mounted on the pair of clamp jaws 502. Additional rod guides 510 can be added to reduce the amount of open space between rod guides 510 so as to prevent a misaligned drill rod section from slipping past rod guides 510 and into the open space between them.

Drill Spindle Alignment Device

Figure 14A:
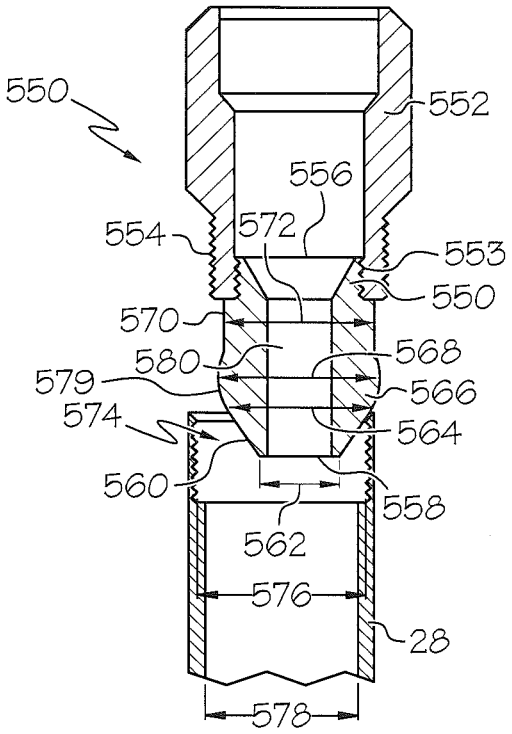
FIG. 14A is a cross-sectional view of a spindle alignment device that can be incorporated into the automated rod manipulator system of FIG. 1 in a misaligned position in accordance with the teachings of the present disclosure.
Figure 14B:
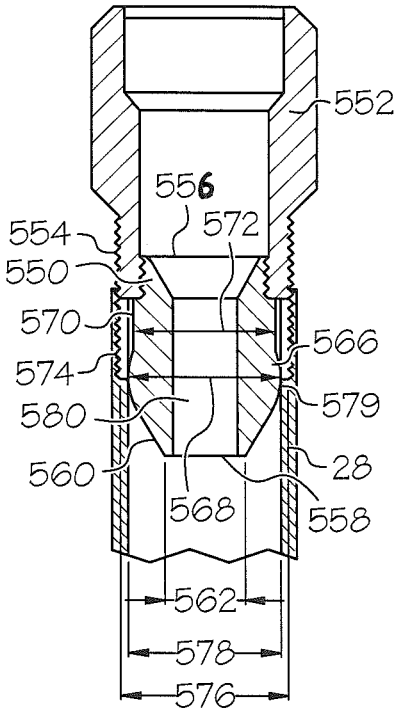
FIG. 14B is a cross-sectional view of a spindle alignment device that can be incorporated into the automated rod manipulator system of FIG. 1 in an aligned position in accordance with the teachings of the present disclosure.

FIGS. 14A and 14B illustrate a drill spindle alignment device 550 operable to align the upper end of a presented drill rod section 28 in gripping arm 16 (shown in FIG. 20) to be coupled to a drill spindle adapter 552 to couple the upper end of the drill section to the rotary drill to allow for rotation of the drill string once drill rod section is also coupled to the drill string. Drill spindle alignment device 550 finely aligns the drill rod section 28 and guides it into engagement with a spindle adapter 552 that is used with a drill spindle when introducing another section of drill rod into the existing drill string. The drill spindle alignment device 550 may also be attached directly to a drill spindle. Drill spindle alignment device 550 is removably coupled to a threaded portion 553 of spindle adapter 552 or may be in one-piece with spindle adapter 552.

As shown in FIG. 14A, spindle alignment device 550 has a top 556 and a bottom 558 defining a length. Spindle alignment device 550 may comprise a lower-most portion that is a frusto-conical lower angled surface 560. Frusto-conical lower angled surface 560 is defined at bottom 558 by a bottom diameter 562 and along the length of spindle alignment device 550 by a top diameter 564 wherein top diameter 564 is larger than bottom diameter 562. A rounded portion 566 is proximate a middle portion of spindle alignment device 550 and is above the frusto-conical portion 560 wherein rounded portion 566 has a diameter 568. The upper portion of the rounded portion 566 may extend inwardly wherein the upper portion of spindle alignment device is a tubular portion 570 having a tubular diameter 572. Tubular diameter 572 is less than diameter 568 of rounded portion 566.

As shown in FIG. 14B, narrowed bottom 558 of spindle alignment device 550 will be inserted into threaded portion 574 of drill rod section 28 even if it is out of centerline alignment as bottom diameter 562 is less than a diameter 576 of threaded portion 574. As the inclined wall of the frusto-conical portion 560 guides and begins to center spindle 552 on drill rod section 28 as spindle 552 is lowered or drill rod section 28 is raised such that spindle adaptor 552 engages top threaded portion 574 of drill rod section 28. The slope and length of the frusto-conical portion is arranged such that a rod having maximum misalignment does not fall outside the bounds of the inclined surface at narrowed bottom 558. Top threaded portion 574 has an inner diameter 576 and drill rod section 28 also has a standard inner diameter 578 wherein the standard inner diameter 578 is less than the inner diameter 576 of threaded portion 574.

As shown in FIGS. 14A and 14B, diameter 568 of rounded portion 566 is slightly less than the standard inner diameter 578 of drill rod section 28. Inner diameter 578 of drill rod section 28 slides relative to rounded portion 566 while the full length of the threaded portion 574 is being made up during threaded engagement. It is preferable that the apex or vertex 579 of rounded portion 566 is located a sufficient distance away from the spindle threaded portion 554 which is also similar to or greater than the length of the threaded portion 574 of drill rod section 28. This ensures that the rod is brought into full alignment prior to thread engagement so as to prevent unwanted cross threading. FIG. 14B shows the full, non-threaded inner diameter 278 of the drill rod section 28 just slightly above the vertex or apex 579 of rounded portion 566 prior to the rod and spindle adapter threads making contact. Rounded portion 566 is important as it is capable of guiding slightly skewed drill rod section 28 into alignment with spindle 552 without wedging or binding against it. Also for this reason, spindle alignment device 550 includes a tubular portion 570 above rounded portion 566 and having a diameter 572 that is less than diameter 568. As shown in FIGS. 14A and B, spindle alignment device 550 may also include a fluid passage 580 through its entire length which facilitates the flow of drilling fluids.

Drill Rod Tripping Assembly

Figure 15A:
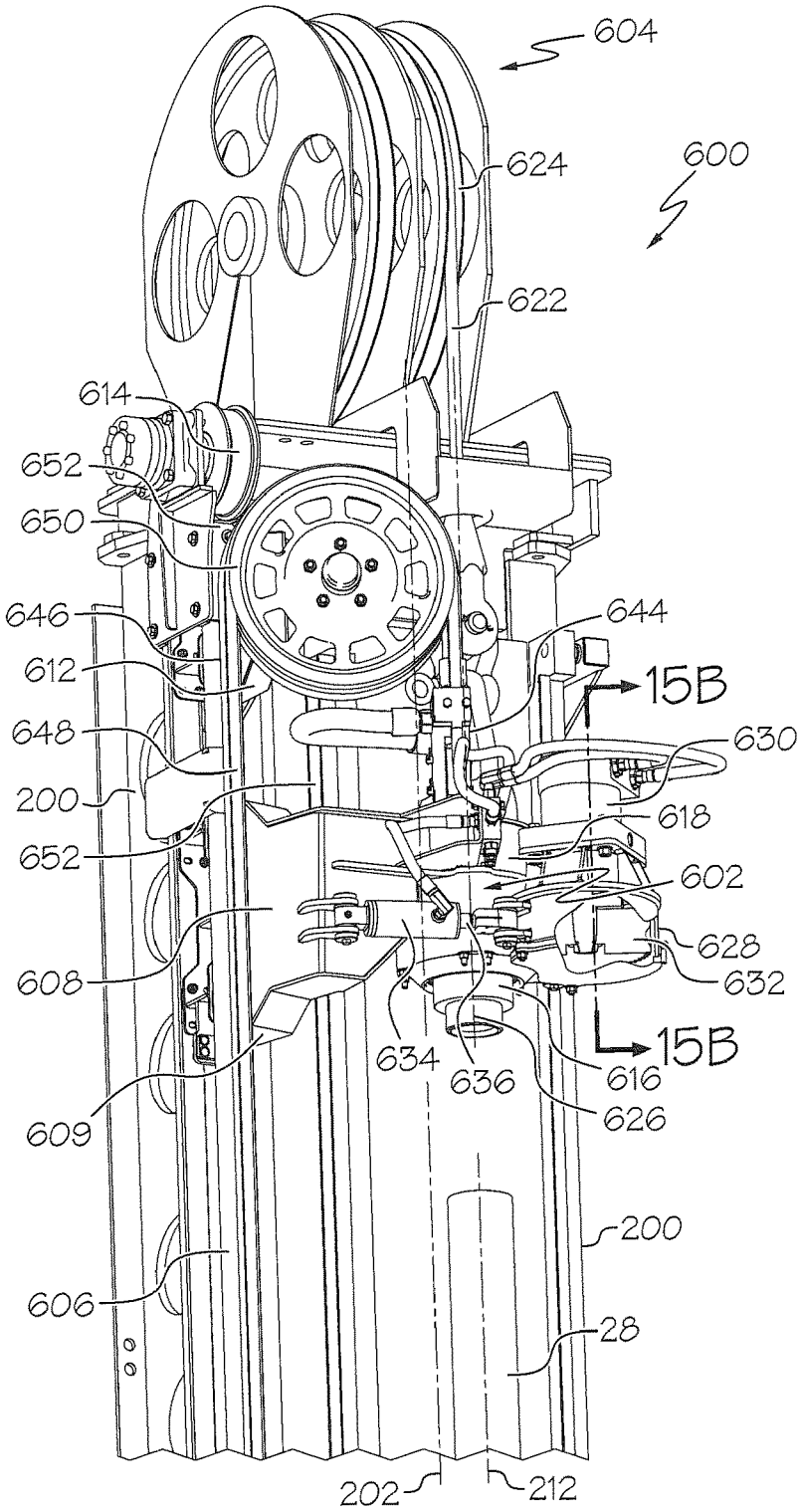
FIG. 15A is a side perspective view of one embodiment of a rod tripping assembly that can be incorporated into the automated rod manipulator system of FIG. 1 in accordance with the teachings of the present disclosure.
Figure 16:
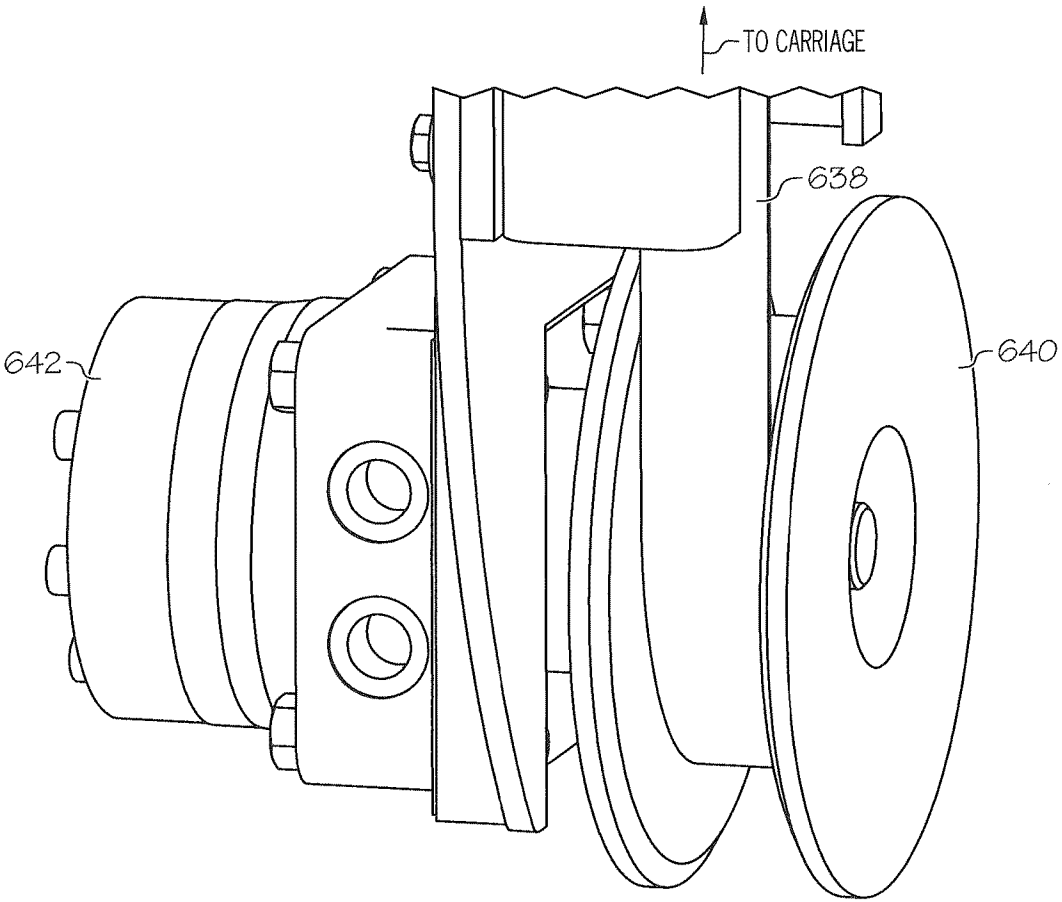
FIG. 16 is a perspective view of a tensioning device of the rod tripping assembly of FIGS. 15A and 15B.

As shown if FIG. 15A, a drill rod tripping assembly 600 allows the operator to safely add and remove drill rods to and from the drill string in a completely hands-free manner. The drill rod tripping assembly 600 allows safe and hands-free raising and lowering of a drill rod or a drill string for the purpose of adding or removing drill rod to and from a drill string. Drill rod tripping assembly 600 is generally used within chuck-drive drill systems, but the teachings herein could be modified for a number of drilling applications. Drill rod tripping assembly 600 also provides bi-directional rotation to a swivel stem 602 (and/or swivel adapter) and allows axial translation of the swivel 602 along a path which is coincident with drill string centerline 212 adjacent to drill rig mast 200. As shown in FIG. 15A, drill rod tripping assembly 600 utilizes the existing wire rope hoist 604 for raising and lowering swivel 602, and further includes a guide rail 606, a swivel carriage 608, and a swivel carriage tensioner 610 (as shown in FIG. 16). Drill rod tripping assembly 600 may also include a hose carriage 612 and a hose carriage tensioner 614.

Figure 15B:
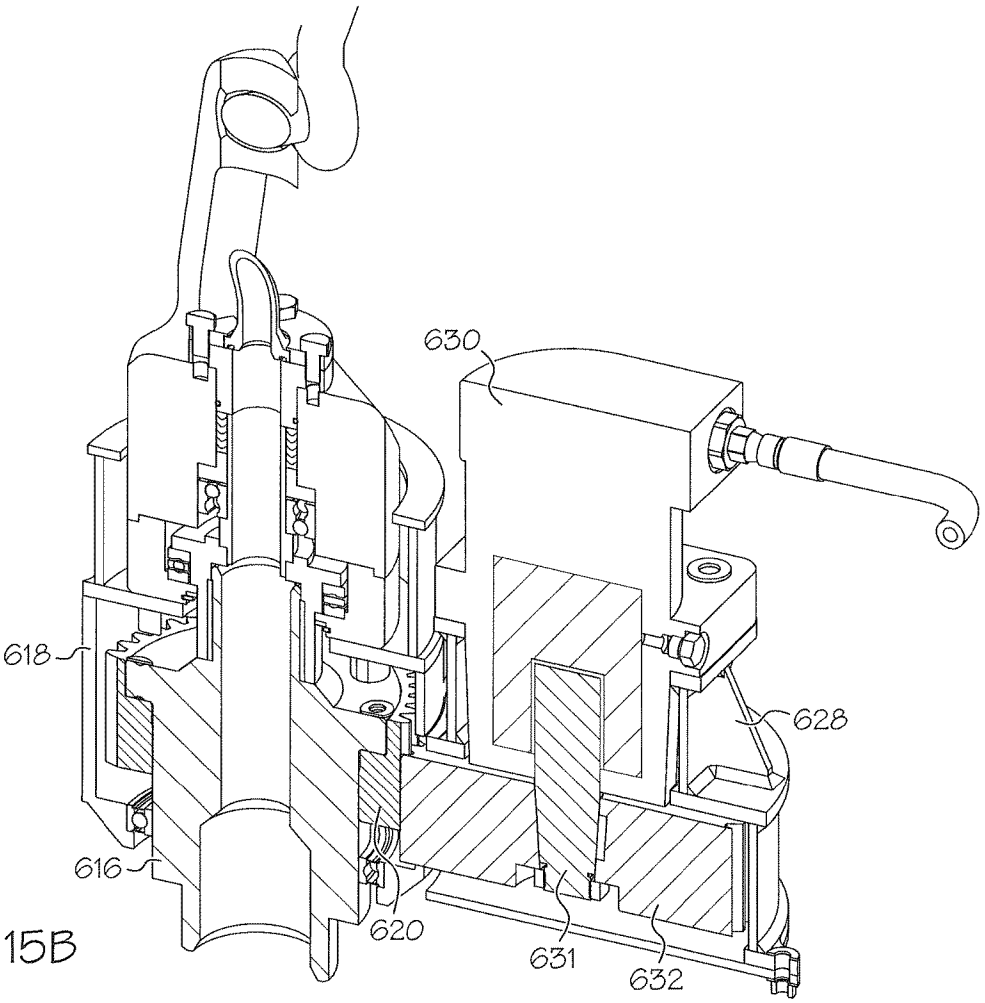
FIG. 15B is a sectional view of the rod tripping assembly of FIG. 15A in a retracted position and cut along the line 15B-15B.

Swivel 602 generally comprises a swivel inner stem 616 which freely rotates within swivel outer housing 618. As shown in FIG. 15B, inner stem 616 is journaled for rotation within swivel outer housing 618 so that lifting or lowering outer housing 618 results in the identical lifting and lowering of inner stem 616. As shown in FIG. 15B, swivel inner stem 616 has a gear 620 around its perimeter.

Now turning back to FIG. 15A, outer housing 618 of a chuck-drive drill system is attached to a wire rope 622 of wire rope hoist 604 thereby suspending swivel 602. Wire rope hoist 604 includes a sheave 624 fixedly mounted for rotation at a top of drill rig mast 200. Wire rope 622 is suspended and lays over sheave 624. Swivel 602 may be raised and lowered using wire rope 622 using a winch (not shown) or similar device for letting out or pulling in a length of wire rope 622.

Guide rail 606 may be mounted to the side of and may run parallel to the longitudinal axis 202 of drill rig mast 200. Swivel carriage 608 engages guide rail 606 and includes a plurality of rollers (not shown) which allow for axial translation of carriage 608 along the full length of guide rail 606. The rails 606 and rollers 608 are oriented to prevent any rotations or translations of the carriage in a plane perpendicular to the longitudinal axis 202 of the drill rig mast 200 and guide rail 606. Swivel carriage 608 extends from the guide rail 606 and is coupled to outer housing 618 of swivel 602 at a location such that swivel centerline 626 is coincident with the spindle centerline 212. In an alternative embodiment, outer housing 618 may be included in swivel carriage 608 and may be integral therewith.

FIG. 15A shows swivel carriage 608 including a swing arm 628 which is pivotally mounted thereto proximate outer housing 618. As shown in FIG. 15B, swing arm 628 includes a hydraulic motor 630 wherein motor 630 is configured to rotate a drive shaft 631 about an axis of rotation parallel to drill string/spindle centerline 212. A pinion 632 is fixedly mounted to the drive shaft of hydraulic motor 630. Now back to FIG. 15A, a single-acting hydraulic cylinder 634 is pivotally attached to swivel carriage 608 proximate guide rail 606 and actuates a cylinder rod 636 extending from hydraulic cylinder 634 to swing arm 628 wherein cylinder rod 636 is pivotally connected to swing arm 628 such that the linear retraction and extension of cylinder rod 636 in a direction perpendicular to the longitudinal axis 202 of drill rig mast 200 pivots swing arm 628 toward and away from outer housing 618. Under spring action the hydraulic cylinder rod 636 is extended which pivots swing arm 628 and its associated components away from the swivel carriage 608 in a non-energized, spring biased position.

In this non-energized, spring-biased condition pinion 632 and gear 620 do not make driving engagement with each other and swivel inner stem 616 is allowed to rotate with the chuck drive at relatively high velocity. When a drill rod section 28 is desired to be attached to swivel 602, under hydraulic action the hydraulic cylinder 634 retracts cylinder rod 636, opposing the extension spring (not shown), thereby drawing swing arm 628 toward outer housing 618 of swivel carriage 608 which brings the respectively attached pinion 632 and gear 620 into driving engagement with each other as shown in FIG. 15B. In the hydraulically energized condition, the pinion 632 is able to transfer torque to gear 620 and impart relatively low velocity rotation to the swivel inner stem 616 which allows it to be threaded or screwed into or out of the upper terminal end of the drill string in a hands-free manner. The torque transfer may be made directly from pinion 632 to gear 620 through a cut-out in outer housing 618 as shown or, alternatively, a transfer gear may be implemented and disposed in housing 618 to transfer the torque. The wire-rope hoist (not shown) may be synchronized to simultaneously lower the swivel as the inner swivel stem 616 is screwed into the drill rod section 28.

Swivel carriage tensioner 610 (FIG. 16) is attached between the lower end of drill rig mast 200 and the lower face 609 (FIG. 15A) of swivel carriage 608 (FIG. 15A) along rails 606. Swivel carriage tensioner 610 opposes the wire rope action and keeps the wire rope taut and is positioned below the swivel carriage 608. Swivel carriage tensioner 610 provides smooth, responsive axial motion and prevents the wire rope 622 (FIG. 15A) from becoming loose which could cause spooling issues with the sheave or winch drum. As shown in FIG. 16, one embodiment of swivel carriage tensioner 610 may comprise a strap 638 that is fixedly attached and configured to be wound around a drum or spool 640. The other end of the strap 638 is coupled to the lower face 609 (FIG. 15A) of swivel carriage 608 (FIG. 15A). Drum 640, in turn, is mounted for rotation and drivingly engaged to a hydraulic motor 642. Motor 642 is energized and biased in a direction which would cause a winding of the strap 638 around the drum 640. The hydraulic motor 642 is fed a supply of hydraulic fluid creating a differential pressure between its working ports at a level which creates the proper torque and resultant tensioning force in the strap 638. This tensioning force is many times lower than the lifting capacity of the wire rope hoist and therefore the wire rope is able to overcome the downward-acting tensioning force and raise swivel 602 and associated components in an upward direction, thus back-driving hydraulic motor 642 of the tensioner 610. The tensioner motor 642 is maintained with a fixed differential pressure across its working ports such that a stable tensioning torque and resultant tensioning force is developed, regardless of whether swivel 602 is being raised or lowered.

As best shown in FIG. 15A, rod tripping assembly 600 may include a hose carriage 612 and a hose carriage tensioner 614. Drilling fluid, typically water for diamond core drilling, must be admitted into an inlet 644 of swivel 602. This fluid may be transferred to swivel 602 using a single high pressure hose 646 having sufficient pressure and flow ratings. In a similar manner, hydraulic fluid must be circulated through rotation drive motor 630 through two high pressure hydraulic hoses 648. High pressure hose 646 and hydraulic hoses 648 originate at their respective supplies on the drill rig and terminate at their respective destinations on swivel carriage 608. Swivel carriage 608 may translate along the full length of drill rig mast 200 and the hoses must also accommodate this range of motion. Hose carriage 612 is provided which is independent from and located above the swivel carriage 608. Hose carriage 612 engages with the guide rail 606 and allows for axial translation of hose carriage 612 while restraining motion in a plane which is perpendicular to the guide rail and longitudinal axis 202 of drill rig mast 200. Hose carriage 612 extends outward from guide rail 606 wherein a hose sheave 650 is pivotally mounted to hose carriage 612. Hose sheave 650 allows for an up-and-over arrangement of high pressure hose 646 and hydraulic hoses 648. Hose sheave 650 contains half-round grooves on its periphery which are formed to the particular size or diameter of the hoses being routed over sheave 650. Hose sheave 650 has a diameter and orientation such that of high pressure hose 646 and hydraulic hoses 648 fleet away from hose sheave 650 in a location directly or nearly directly above the respective attachment points, thus keeping of high pressure hose 646 and hydraulic hoses 648 well aligned. Sheave 65 may be configured to retain and guide more or less hoses depending upon the needs of the swivel and related components.

As shown in FIG. 15A, hose carriage tensioner 614 may be employed to keep the hoses taut and in their up-and-over routing configuration. Hose carriage tensioner 614 is attached between the upper end of drill rig mast 200 and a top 652 of hose carriage 608. Hose carriage tensioner 614 is configured substantially the same as swivel carriage tensioner but positioned and configured so as to apply an upward acting tensioning force to the hose carriage. This upward acting tensioning force keeps the hoses taught during operation.

Drill Rod Loading/Unloading Functionality

As shown FIG. 1, carriage 14 and magazine 12 are positioned on jack-up base 66 such that lift tray 104 is aligned with gripping arm 16 in one of lift tray's stop locations. Obtaining the necessary lift tray 104 to gripping arm 16 alignment may be accomplished in at least the following ways: (1) including positioning jack-up base 66 in the exact spot needed with a truck and then lifting jack-up base 66 off the truck with support legs 68, (2) including a multi-directional adjust feature in support legs 68 of jack-up base 66 so that jack-up base 66 may be moved both vertically and laterally so that an operator can fine-tune the position of jack-up base 66, and (3) positioning jack-up base 66 with a crane or other industrial conveyance method. As shown in FIG. 1, in one embodiment, jack-up base 66 includes at least four support legs 68 which are vertically adjustable using motorized controls. In a related embodiment, support legs 68 of jack-up base 66 are laterally adjustable allowing (1) support legs 68 of jack-up base 66 to be in a "retracted" position during transport to meet the over-the-road transport width requirements, and (2) coordinated movement of two laterally aligned legs 68 to shift the entire jack-up base 66 from side-to-side in a linear direction to position the magazine relative to the gripping arm 16 of the drill rig. Support legs 68 at each end may have this functionality allowing jack-up base 66 to have an adjustable height, lateral position and angular position about a vertical central axis and a horizontal axis. The height adjustment of support legs 68 allows jack-up base 66 to be positioned on uneven ground wherein each support legs 68 is individually adjustable to provide mostly horizontally level orientation. Preferably, jack-up base 66 is substantially horizontally level, but the pivot capability of gripping arm 16 can compensate for some angular deviation from horizontal.

Once the position of jack-up base 66 is established, carriage 14 and magazine 12 can be installed as components on top of jack-up base 66. As described above, magazine 12 may be configured in the shape of an ISO standard shipping container and may include the standard ISO container locks. Jack-up base 66 and/or the carriage 14 may also be configured for the ISO standard connectors for easily securing magazine 12 and/or carriage 14 to jack-up base 66. Another embodiment not shown includes a self-contained unit that includes adjustable legs 68 associated with the jack-up base 66, carriage 14 and magazine 12 in one integrated unit that may be transported from drill-site to drill-site. Alternatively, each component may remain independent and assembled on-site or remotely using any connectors or connection method now known or hereafter developed.

Figure 17:
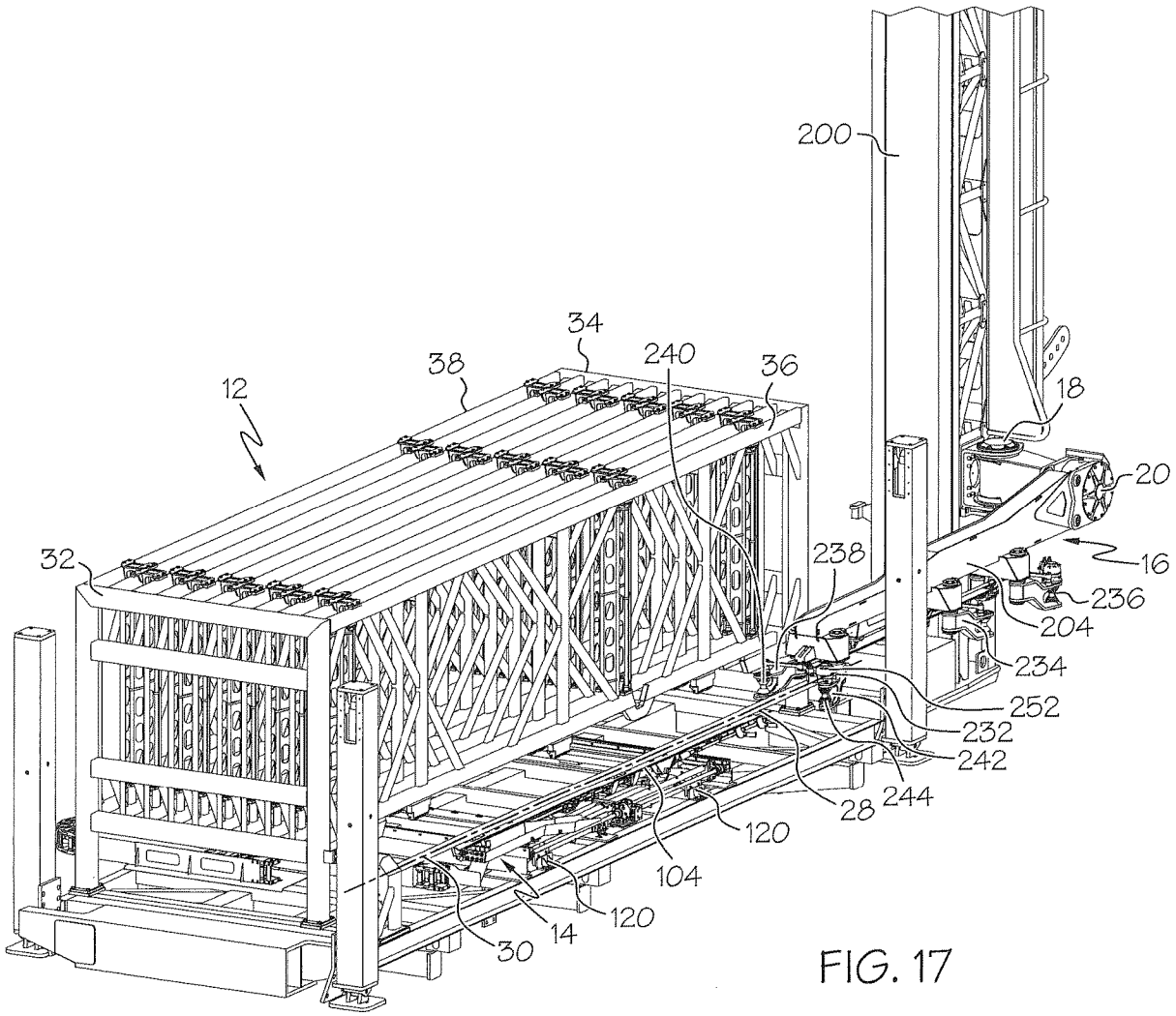
FIG. 17 is a perspective view of the automated rod manipulator system of FIG. 1 showing a drill rod section positioned on the lifting tray and being gripped by one clamp of the gripping arm.
Figure 18:
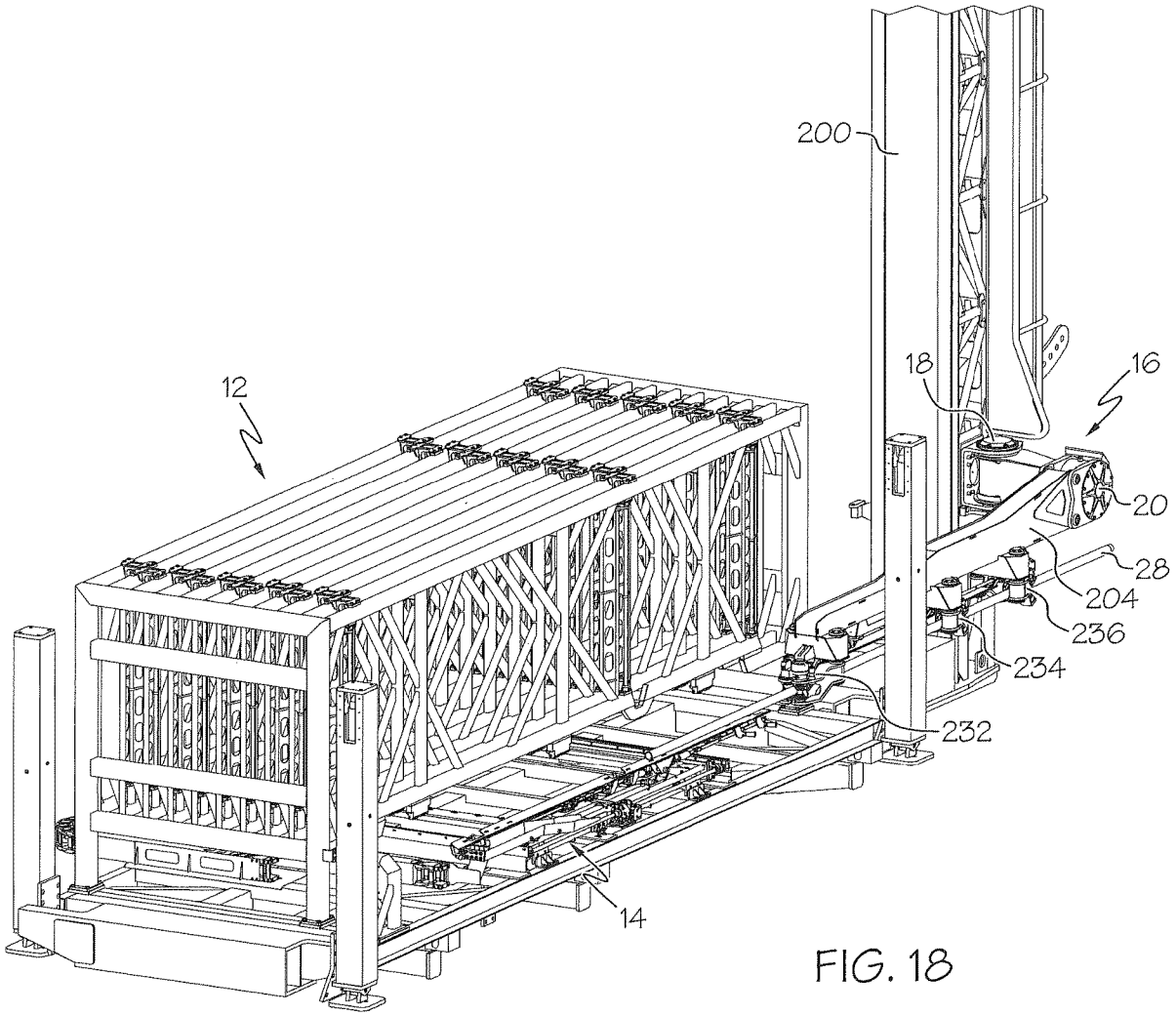
FIG. 18 is a perspective view of the automated rod manipulator system of FIG. 1 showing the drill rod section translated into a full grip position in the gripping arm.

As shown in FIG. 7, the process of loading a drill rod section 28 using ARM 10 begins by traversing carriage 14 to a position below a column space 46 of magazine 12 that includes one or more drill rod sections 28. Following the procedure described in the "Lift Tray" section above, one drill rod section 28 is removed from a column space 46 of magazine 12 and carriage 14 and supported drill rod section 28 traverse to the hard-stop 120 position on first side 36 of magazine 12 as shown in FIG. 17. As further shown in FIG. 17, lift tray 104 presents the drill rod section at a transfer position such that the longitudinal axis of rotation 30 of drill rod section 28 lies along the centerline of the roller clamps 232, 234, and 236 when main arm 204 is lowered to a substantially horizontal position by pivot drive 20. The transfer position may coincide with a fully lowered or fully raised position of the tray, or any position located therebetween. In the transfer position, as shown in FIG. 17, only first roller clamp 232 overlaps the end of drill rod 28 closest to drill rig mast 200. Clamp arms 238 and 242 of first roller clamp 232 are closed onto drill rod section 28 and drive motor 252 is turned on in the appropriate direction to turn roller 244 thereby translating the drill rod section 28 from the lift tray 104 toward second and third clamps 234 and 236 into a position where it can be safely gripped by gripping arm 16 upon closing second and third clamps 234 and 236. FIG. 18 illustrates this fully gripped position wherein all three clamps 232, 234, and 236 are clamping drill rod section 28 wherein the drill rod section 28 is substantially horizontal.

Figure 19:
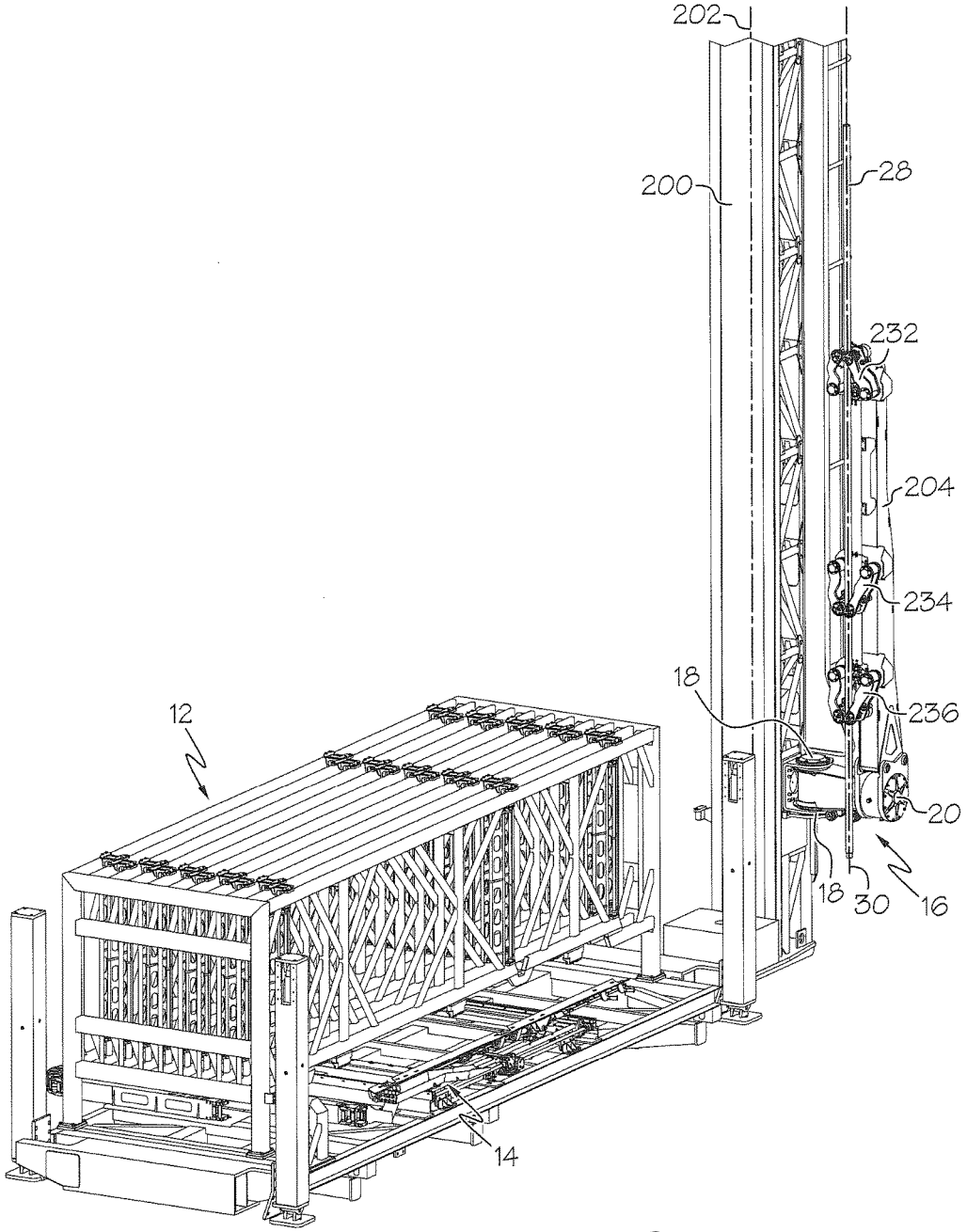
FIG. 19 is a perspective view of the automated rod manipulator system of FIG. 1 showing the drill rod section secured in the gripping arm and pivoted into a substantially vertical position.

At this point and as shown in FIG. 19, pivot drive 20 can be activated to raise main arm 204 and clamped drill rod section 28 from a substantially horizontal position to a substantially vertical position and substantially parallel to the longitudinal axis 202 of drill rig mast 200. In one embodiment, proximity sensors will not allow the pivot drive to operate if each clamp does not sense the presence of the drill rod section. As shown in FIG. 20, following the pivot motion of pivot drive 20, swing drive 18 can then be activated to swing main arm 204 and clamped drill rod section 28 to an alignment with spindle centerline 212.

When a drill rod section 28 is swung to align with the spindle centerline 212, the motorized clamps 232 and 236 may linearly translate the drill rod section 28 up and down as desired to engage the drill rotary drive or a swivel above, and/or the drill string below. As such, the clamps 232 and/or 236 may move drill rod section upward so that it may then be first threaded onto the rotary box spindle adapter 552 (as shown in FIGS. 14A and 14B) or swivel 602 (as shown in FIG. 15A) and subsequently lowered into engagement with and threaded onto a lower mating string of drill rods. As shown in FIGS. 14A and 14B, drill rod section 28 may be placed into alignment with spindle 552 using drill spindle alignment device 550 wherein drill rod section 28 is raised by motorized rollers 232 and/or 236 to engage the drill spindle alignment device 550. As shown in FIGS. 13A and 13B, gripped drill rod section may be placed in alignment with the drill string secured in foot clamp 500 using alignment assembly 24 to guide drill rod section 28 into exact alignment with the upper most section of the drill string without any manual manipulation as they are lowered. Moreover, the rotation of the spindle may act to both couple the spindle adapter to the drill rod section and, then, threadably engage the drill rod section to the existing drill string. In another embodiment shown in FIGS. 15A and 15B, the top end of drill rod section 28 may be coupled to swivel 602 using rod tripping assembly 600 as described above and another alignment assembly (not shown) may be associated with a chuck-drive that feeds drill rod section 28 into gripping component of the chuck-drive. Inner swivel stem 616 may include an alignment device (not shown) similar to that of spindle alignment device 550 which helps align swivel stem 616 and a drill rod section 28. Swivel stem 616 is threadably engaged and coupled to the drill string as described above, and then the drill rod section is rotated by the chuck-drive to threadably engage and couple the drill rod section 28 to the drill string. In another embodiment, a horizontal roller (not shown) on one of the clamp arms 238 or 242 may rotate drill rod section 28 to thread it and removably couple drill rod section 28 to the drill string below. In this manner sections of the drilling rod may be sequentially added to the upper terminal end of the drill string.

The reverse procedure can be used to sequentially remove a drill rod section from the upper terminal end of the drill string and return them to the appropriate storage column within the magazine.

From the foregoing it will be seen that this invention is one well adapted to attain all ends and objects hereinabove set forth, together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matters herein set forth or shown in the accompanying drawings is to be interpreted as illustrative, and not in a limiting sense.

What is claimed is:

1. An automated rod manipulator system comprising:

a magazine to store and dispense a plurality of drill rod sections;

a carriage to convey one of said plurality of drill rod sections from the magazine;

a gripping arm coupled to a drill rig mast of a drilling rig, said gripping arm operable to convey one of said plurality of drill rod sections from a transfer position to a position aligned with a spindle center line of said drilling rig, wherein said magazine comprising:

a plurality of column spaces defined by a pair of laterally adjacent upper support beams and a pair of laterally adjacent lower support beams;

a plurality of column doors disposed between the upper and lower support beams to laterally support a stack of one or more of said plurality of drill rod sections; and a plurality of rod-retaining latches connected between said lower support beams and said column spaces.

2. The system of claim 1 wherein said column doors are pivotally mounted within said magazine and include a tensioner which applies a spring-generated force to clamp said column doors against said stack of one or more of said plurality of drill rod sections in said at least one column space.

3. The system of claim 1 wherein said carriage includes a lift tray configured to raise to engage a lower-most drill rod section of said stack of one or more of said plurality of drill rod sections within said at least one column space, and said lift tray operable to lower and remove said lower-most drill rod section from said magazine and convey said lower-most drill rod section to a hard-stop location and position said lower-most drill rod section at a transfer position.

4. The system of claim 3 wherein said lift tray includes a plurality of release levers to engage and pivot said rod-retaining latches to release said lower-most drill rod section of said stack of one or more of said plurality of drill rod sections for removal from said magazine.

5. The system of claim 1 wherein said gripping arm includes a main arm having at least one clamp for securing said one of said plurality of drill rod sections, said gripping arm further including a pivot drive for pivoting said main arm between a substantially horizontal position and a substantially vertical position, and a swing drive for swinging said main arm into alignment with a spindle centerline of said drill rig.

6. The system of claim 5 wherein said at least one clamp is hydraulically powered.

7. The system of claim 5 wherein said main arm includes three roller clamps, each clamp comprising a first clamp aim and a second clamp arm pivotally coupled to said main arm, each clamp arm having rollers disposed thereon and journaled for rotation relative to its clamp arm, wherein at least one roller of one of said clamps having a motorized roller.

8. The system of claim 7 wherein said motorized roller includes a serrated roller surface.

9. The system of claim 8 wherein said motorized roller includes a double serrated roller surface including a plurality of pyramidal fingers extending outwardly and substantially perpendicular to the roller face.

10. The system of claim 7 wherein a first clamp is disposed at a free end of said main arm, wherein said first clamp is independently closeable with respect to the remaining clamps and said first clamp includes the motorized roller that is independently operable from the remainder of said clamps.

11. The system of claim 1 further comprising a jack-up base wherein said jack-up base includes at least four support legs, said support legs providing both vertical and horizontal adjustment of said jack-up base.

12. The system of claim 1 further comprising a control system for monitoring and controlling the operation of the system.

13. The system of claim 1 further comprising a rod alignment assembly coupled to a foot clamp of said drill rig.

14. The system of claim 1 further comprising a drill spindle alignment device coupled to said drill spindle.

15. The system of claim 1 wherein said drill rig is a chuck-drive drilling system, said system further comprising an automatic rod tripping assembly for threading a swivel to one of said plurality of drill rod sections when said drill rod section is at said position aligned with said spindle center line of said drilling rig.

16. A method for transporting a drill rod section from a storage magazine to the spindle centerline of a drill rig without manually handling said drill rod section, said method comprising:

removing said drill rod section from the bottom of a stack of one or more drill rod sections in a column space of a storage magazine with a lift tray of a carriage;

lowering said lift tray of said carriage to a transport position, said drill rod section resting upon said lift tray;

translating said lift tray and said drill rod section on one or more rails to a hard-stop position;

positioning said lift tray and said drill rod section to a transfer position, said transfer position being substantially horizontal;

gripping said drill rod section with at least one clamp on a main arm of a gripping arm, said gripping arm operably connected to a mast of said drill rig;

translating the drill rod section from the transfer position to a pivot position using a motorized roller of the at least one clamp;

pivoting said drill rod section and said main arm with a pivot drive of said gripping arm to a substantially vertical position, wherein said drill rod section is substantially parallel with a longitudinal axis of said mast of said drill rig;

swinging said drill rod section and said main arm with a swing drive of said gripping arm so that a longitudinal axis of rotation of said drill rod section is substantially aligned with a spindle centerline of said drill rig; and engaging said drill rod section with an existing drill string and a drill string rotary drive.

17. An automated rod manipulator system comprising:

a magazine to store and dispense a plurality of drill rod sections, wherein said magazine comprising:

a plurality of column spaces;

a plurality of column doors;

a plurality of rod-retaining latches;

a carriage to convey one of said plurality of drill rod sections from the magazine to a transfer position;

a gripping arm coupled to a drill rig mast of a drilling rig, said gripping arm operable to convey one of said plurality of drill rod sections from a transfer position to a position aligned with a spindle center line of said drilling rig;

a non-transitory machine-readable medium having stored thereon a control system executable instructions configured to:

remove said drill rod section from the bottom of a stack of one or more drill rod sections in a column space of a storage magazine with a lift tray of a carriage, lower said lift tray of said carriage to a transport position, said drill rod section resting upon said lift tray, translate said lift tray and said drill rod section on one or more rails to a hard-stop position, set a position said lift tray and said drill rod section to a transfer position, said transfer position being substantially horizontal, grip said drill rod section with at least one clamp on a main arm of a gripping arm, said gripping arm operably connected to a mast of said drill rig, translate the drill rod section from the transfer position to a pivot position using a motorized roller of the at least one clamp, pivot said drill rod section and said main arm with a pivot drive of said gripping aim to a substantially vertical position, wherein said drill rod section is substantially parallel with a longitudinal axis of said mast of said drill rig, swing said drill rod section and said main aim with a swing drive of said gripping arm so that a longitudinal axis of rotation of said drill rod section is substantially aligned with a spindle centerline of said drill rig, and configure said drill rod section with an existing drill string and a drill string rotary drive.

* * * * *